US009440709B1

(12) United States Patent
Perrone

(10) Patent No.: US 9,440,709 B1
(45) Date of Patent: Sep. 13, 2016

(54) VESSEL AND SHELTER ASSEMBLY

(71) Applicant: Gerard Perrone, New Orleans, LA (US)

(72) Inventor: Gerard Perrone, New Orleans, LA (US)

( * ) Notice: Subject to any disclaimer, the term of this patent is extended or adjusted under 35 U.S.C. 154(b) by 0 days.

(21) Appl. No.: 14/827,139

(22) Filed: Aug. 14, 2015

Related U.S. Application Data

(60) Provisional application No. 62/037,792, filed on Aug. 15, 2014.

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02; B63B 17/04
USPC ..... 114/361, 364; 135/88.01
See application file for complete search history.

(56) References Cited

U.S. PATENT DOCUMENTS

| | | | |
|---|---|---|---|
| 2,634,740 | A | 4/1953 | Duke |
| 2,769,451 | A | 11/1956 | Edgin |
| 2,889,839 | A | 6/1959 | Sheridan, Jr. |
| 3,604,440 | A | 9/1971 | Wilson |
| 3,698,409 | A | 10/1972 | Koontz |
| 3,896,832 | A | 7/1975 | Montoya |
| 4,300,253 | A | 11/1981 | Anderson |
| 4,593,641 | A | 6/1986 | Adams |
| 4,671,203 | A | 6/1987 | Sanburg |
| 4,979,456 | A | 12/1990 | Steward |
| 5,441,066 | A | 8/1995 | Harris |
| 5,458,079 | A | 10/1995 | Matthews |
| 5,615,633 | A | 4/1997 | Cripe |
| 6,129,034 | A | 10/2000 | Santa Cruz |
| 6,286,449 | B1 | 9/2001 | Giffin |
| 6,769,379 | B2 | 8/2004 | Foiles |
| 6,830,005 | B2 | 12/2004 | Dunn |
| 7,063,035 | B2 | 6/2006 | Belcher |
| 7,401,566 | B1 | 7/2008 | Miknich |
| 7,418,919 | B2 | 9/2008 | Smith |
| 8,096,310 | B2 | 1/2012 | Clarke |
| 2011/0005560 | A1 | 1/2011 | Nair |

*Primary Examiner* — Lars A Olson
(74) *Attorney, Agent, or Firm* — Andrew Vicknair

(57) ABSTRACT

A vessel and shelter assembly system that quickly converts a low profile boat into a floating teepee/tent that is capable of multiple functions and can enable a boater/passenger to spend multiple days/nights out on protected waters, marsh, or swamp without limiting the functions of the boat.

18 Claims, 20 Drawing Sheets

FIG. 5 A
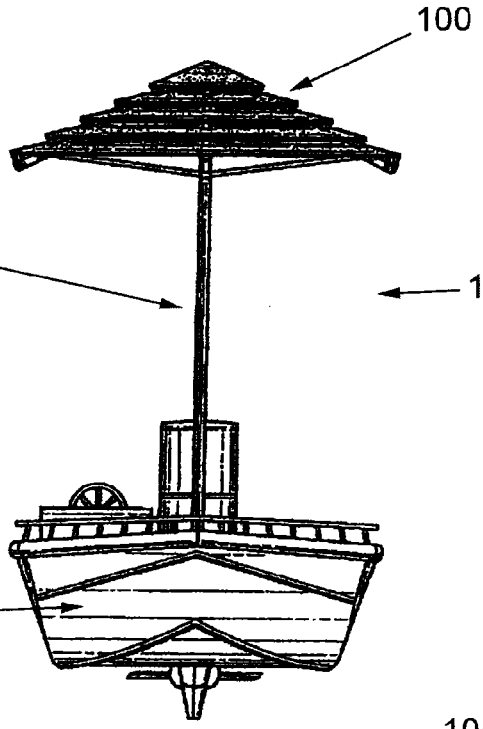
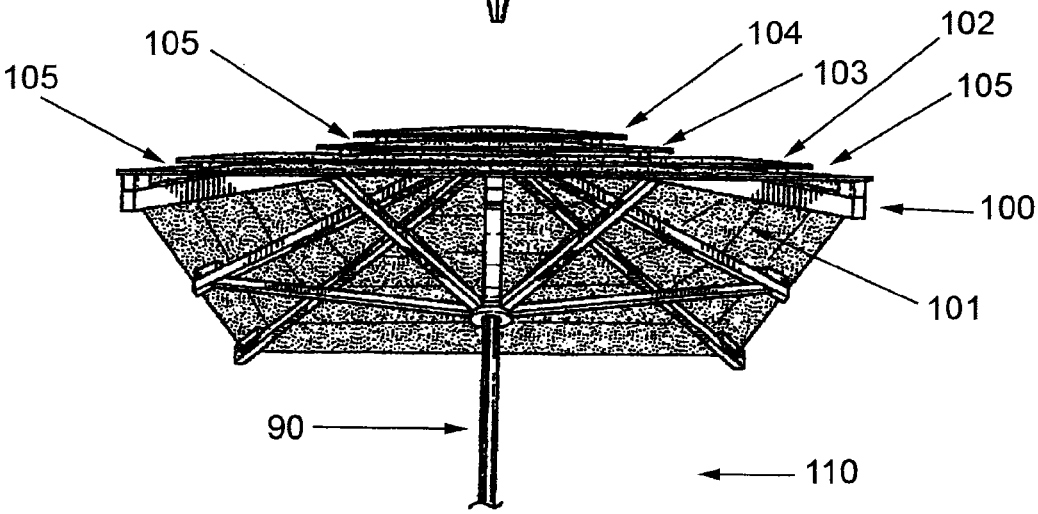
FIG. 5 B

VESSEL AND SHELTER ASSEMBLY

CROSS REFERENCE TO RELATED APPLICATIONS

This application claims the benefit of U.S. provisional application Ser. No. 62/037,792 filed on Aug. 15, 2014.

TECHNICAL FIELD

The present invention relates, in general to a vessel and shelter assembly system that can convert a vessel with a low profile hull into a floating teepee/tent or blind or vessel and shelter assembly capable of multiple configurations and functions.

BACKGROUND OF INVENTION

Currently, it is very difficult and uncomfortable for individuals to explore marshland, swamps, and other areas via boat/watercraft for extended time periods. Generally, these areas can be explored during daylight hours, but not for extended periods of time, such as overnight and multi-day trips. While watercraft/boats do exists that allow individuals to explore marshland and swamps, the watercraft does not provide for overnight or multi-day trips whereby individuals can explore and/or stay out in the marshland and/or swamps and still be comfortable and safe from the environment.

While various types of portable umbrellas and shade structures made of various types of fabric do exist that provide passengers of boats/watercraft temporary protections from heat and the effects of the sun, such shade structures and umbrellas are not configured to provide protection and shelter and the protection needed for an individual/passenger of a boat to stay on a boat for extended periods of time, such as multi-day and overnight trips. In addition, the various portable shade structures and umbrellas that currently exists are not adaptable and configurable such that said structures can be configured and utilized to provide complete shelter and cover for an individual to stay on said boats/watercraft on a multi-day trip.

Accordingly, a need exists in the art for a shelter assembly on a vessel that is portable, can be easily stored on a vessel, and can be easily assembled to convert a vessel into a floating tent capable of providing shelter to multiple individuals on a boat and enable said individuals to stay on the vessel for multi-day and overnight trips and have shelter from the environment and withstand various weather conditions, such as high wind and heavy rain.

BRIEF SUMMARY OF THE INVENTION

The present invention is directed to a vessel and shelter assembly apparatus that enables users to spend multiple days/nights out on protected water, marsh or swamp yet, does not materially limit the functions of said vessel.

In one embodiment of the present invention, the functions of the vessel and shelter assembly apparatus of the present invention include, but are not necessarily limited to, the following: provides easily stowed and pitched shelter assembly on the water; allows ventilation for indoor cooking in any weather conditions; provides protection from insects or other animals, including in marshes and swamps; comfortably allows for multiple people to sleep on a single vessel; includes a trampoline deck that provides comfortable, easily cleaned and dried sleeping area (shelter assembly can also work with a rigid boat deck); can be modified to work on multiple different size hulls; can be quickly and easily be pitched from inside by a single person; and can withstand strong winds.

In a preferred embodiment of the present invention, the shelter assembly apparatus includes a zippers and a tension based web tent that allows a user to access entry to said tent from any side of a vessel, top or bottom, and with multiple configurations and is camouflaged to assist with various activities such as hunting, wildlife observation/photography, including an unobstructed 360 degree viewing area.

In an embodiment of the present invention, the apparatus may include an umbrella-like canopy that functions independently from the other shelter components and provides shade protection whereby the canopy may have a single pole design to provide for a 360 degree unobstructed movement when in use. The canopy may also include a series of slots providing a flow through design whereby wind is able to flow through the canopy and prevents the canopy from catching wind so that the canopy may stay up while the vessel is moving through the water and/or marshland.

The foregoing has outlined rather broadly the features and technical advantages of the present invention in order that the detailed description of the invention that follows may be better understood. Additional features and advantages of the invention will be described hereinafter, which form the subject of the invention. It should be appreciated that the conception and specific embodiment disclosed may be readily utilized as a basis for modifying or designing other structures for carrying out the same purposes of the present invention. It should also be realized that such equivalent constructions do not depart from the invention. The novel features which are believed to be characteristic of the invention, both as to its organization and method of operation, together with further objects and advantages will be better understood from the following description when considered in connection with the accompanying figures. It is to be expressly understood, however, that each of the figure(s) is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing(s), in which:

FIG. 5A depicts an end view of the vessel of the present invention with an umbrella-type canopy installed and in an open configuration;

FIG. 5B depicts a front perspective view of an umbrella-type canopy of the present invention in an open configuration;

DETAILED DESCRIPTION OF THE INVENTION

Figure 1:
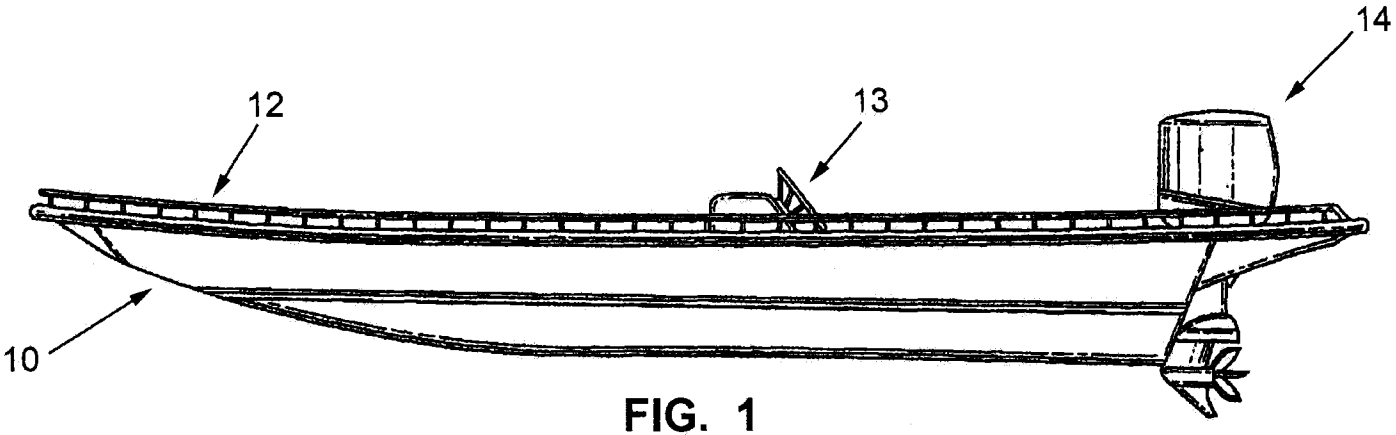
FIG. 1 depicts a side view of the vessel of the present invention.
Figure 2:
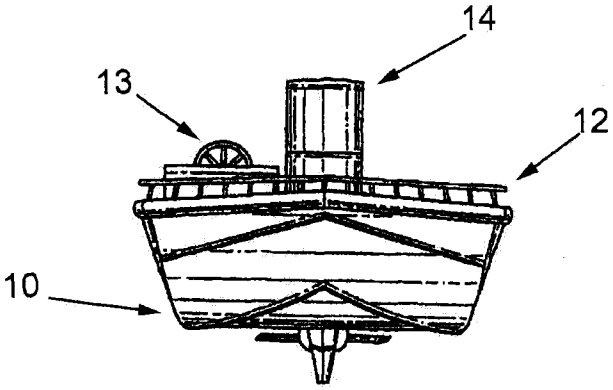
FIG. 2 depicts a front end view of the vessel of the present invention.

FIG. 1 depicts a side view of a vessel and FIG. 2 depicts a front end view of the vessel of FIG. 1 of the present invention. Vessel 10 is preferably a vessel having a low profile hull such that the vessel may be utilized to travel under various obstructions such as low hanging branches and other low hanging obstructions normally found in areas with shallow water, such as marshland or the swamp. In a preferred embodiment vessel 10 is a shallow draft vessel that can easily navigate into shallow waters, such as swamp lands and marshes while still being able to accommodate all of the various components discussed herein. Vessel 10 is also preferably configured with rail 12 that is utilized to assist with tying down and securing various components of the present invention to vessel 10. Rail 12 may be made of any number of materials, including stainless steel and aluminum. Vessel 10 also includes a steering mechanism 13, such as a steering wheel, and a motor 14 that is utilized to power the vessel 10 when in use.

Figure 3A:
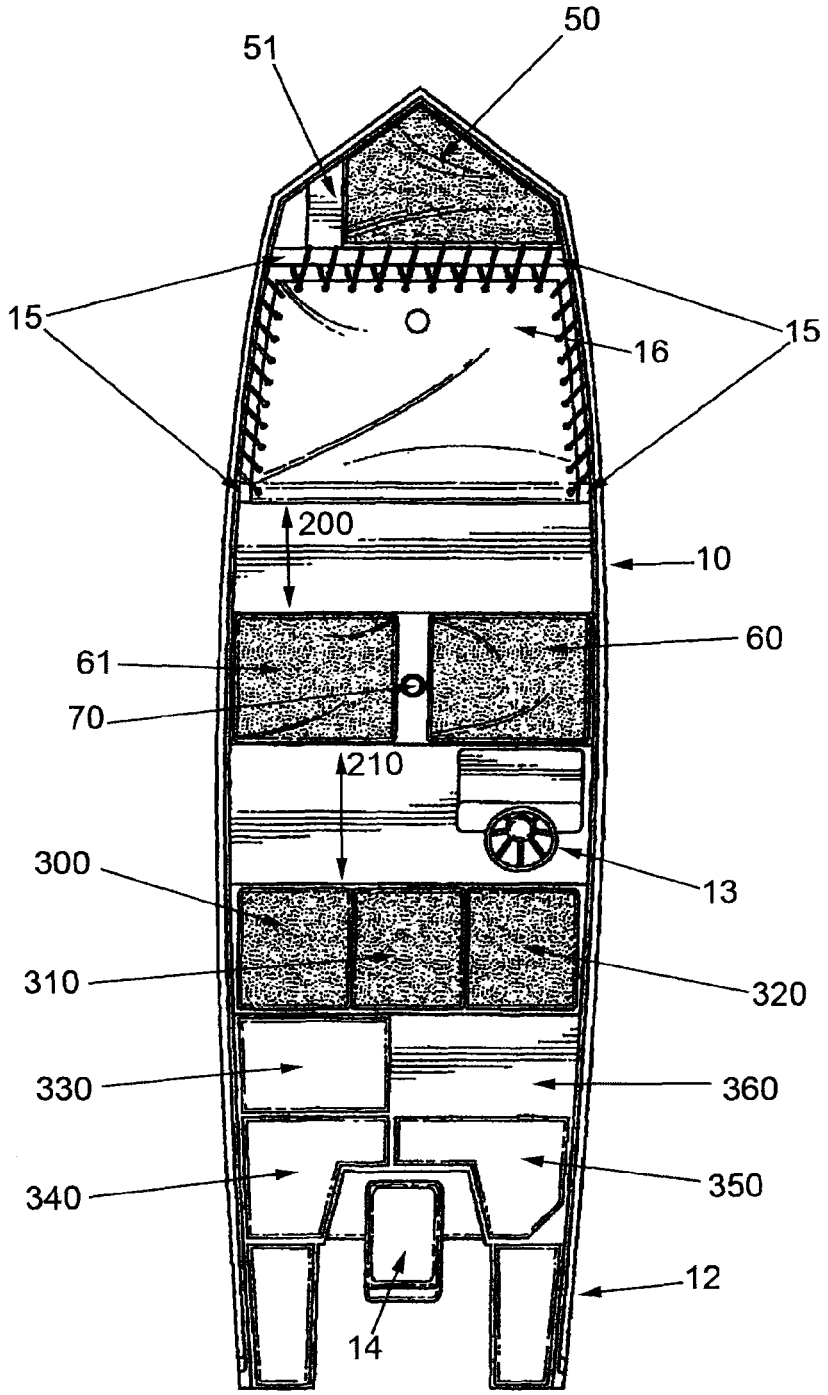
FIG. 3A depicts a top view of the vessel of the present invention.

FIG. 3A illustrates a top view of vessel 10 of the present invention. The vessel and components illustrated in FIG. 3 are various components that make-up portions of one embodiment of the present invention. In particular, FIG. 3 illustrates vessel 10 and other components making up the present invention. As illustrated in FIG. 3, vessel 10 is configured to include trampoline tensioning frame 15 and trampoline 16. Frame 15 may be configured of many different sizes but in one embodiment, frame 15 is sized 1½" by 1½" by ¼" and is preferably comprised of aluminum. Frame 15 operates to provide a means in which trampoline 16 can be stretched out and secured between frame 15. Trampoline 16 is preferably comprised of some type of waterproof material, such as marine canvas, Sunforger canvass, an industrial vinyl, a polyethylene based fabric or other similar material with strength to support certain weights, such as the weight of an individual sitting or lying on trampoline 16. In addition, trampoline 16 may also be configured with a number of grommets spaced evenly around the exterior of trampoline 16 to enable trampoline 16 to be secured to frame 15 with some type of rope or similar product. Trampoline 16 is advantageous as it is a light material which assists in reducing the weight on vessel 10. In addition, trampoline 16 is easy to clean, maintain, and easy to remove to gain access to items underneath trampoline 16.

The present invention may also be configured with space 200 illustrated in FIG. 3A. Space 200 is an open space where passengers sitting on seats 60 and 61 may position their legs and rest their feet when sitting on seats 60 and 61. Space 200 may also be used as storage to store gear utilized when the present invention is in use. Space 200 is also important as it provides passengers with the room and space to stand up completely under tent 600. In the embodiment illustrated in FIG. 3A, trampoline 16 does not extend past frame 15 and into space 200. The size of placement of trampoline 16 is not a limitation on the present invention as trampoline 16 may be configured differently in different embodiments of the present invention.

Figure 3B:
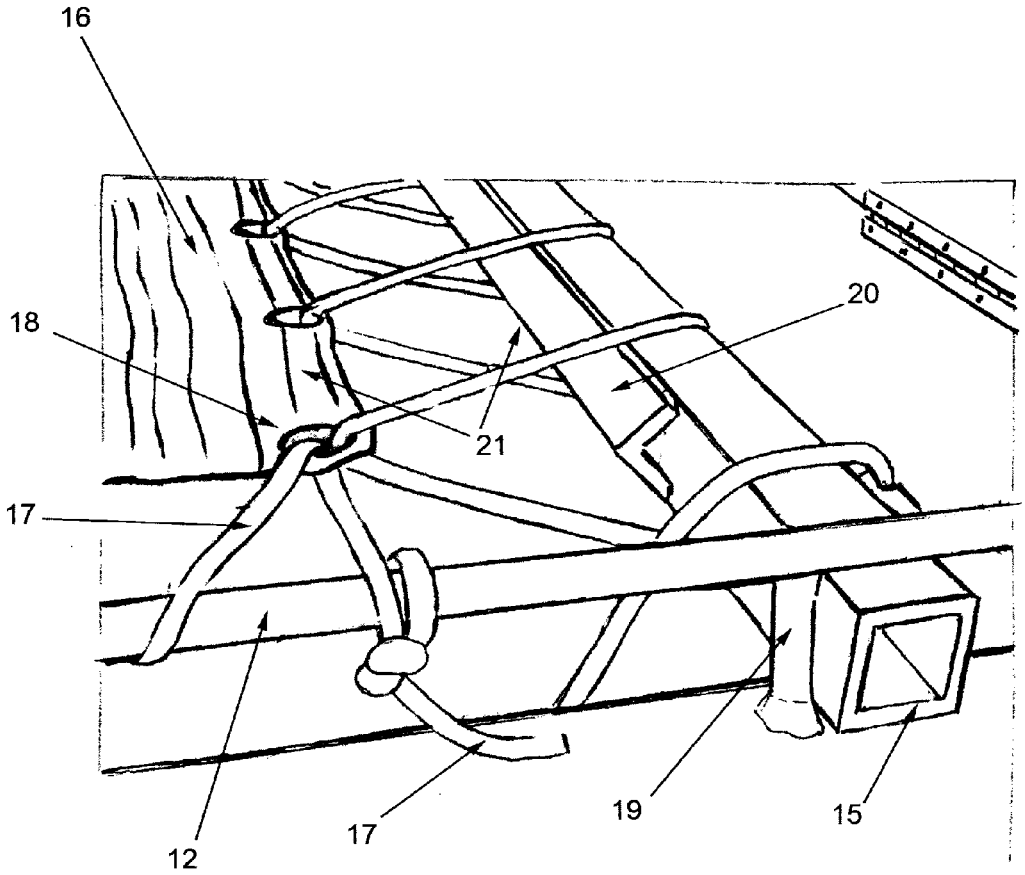
FIG. 3B depicts a close up view of a portion of the trampoline of present invention.

FIG. 3B illustrates a close up view of trampoline 16 and its connection to vessel 10. As illustrated in FIG. 3B, in one embodiment of the present invention, trampoline 16 is stretched out and connected to vessel 10 with the use of rope 17. Rope 17 is preferably some type of double braided polyester rope, but in alternative embodiments, rope 17 may consist of some type of tight cord or other material that may be used to secure trampoline 16 to vessel 10 as illustrated in FIG. 3B. Rope 17 is preferably positioned through the trampoline grommets 18 that are located at the edges of trampoline 16. As illustrated in FIG. 3B, rope 17 is routed through grommets 18 and around rail 12 and around trampoline tensioning frame 15 for the purpose of securing and stretching trampoline 16 between frame 15 and rail 12. In an embodiment of the present invention, rail 12 also includes posts 19 located throughout the rail 12 which acts to secure rail 12 to vessel 10 and provide a gap between vessel 10 and rail 12. Posts 19 also provide strength and support to rail 12.

Frame 15 may also be configured in some embodiments to include an additional strengthening member 20, as illustrated in FIG. 3B. In one embodiment, strengthening member 20 is permanently attached to frame 15 and acts to provide support to frame 15. Member 20 preferably extends a majority of the length of frame 15 and provides rigidity, support to and strengthens frame 15 so that frame 15 can withstand greater weights, such as the weight of an individual standing, sitting, or laying on frame 15. In some embodiments, member 20 may be screwed, bolted, or welded to frame 15 or attached to frame 15 through any other means that will securely attach member 20 to frame 15. In one embodiment, member 20 may be in the form of an angle as illustrated in FIG. 3B, but the present invention is not limited by the angle configuration illustrated in FIG. 3B. In one embodiment, trampoline 16 is secured between frame 15 and rail 12 so that there is a gap 21 that exists between frame 15 and trampoline 16. In a preferred embodiment, gap 21 is at least 5 inches so that users of the present invention are able to access any items stored below and underneath trampoline 16. While 5 inches is a preferred size of gap 21, the present invention is not limited to this configuration and may be different in alternative embodiments.

Figure 3C:
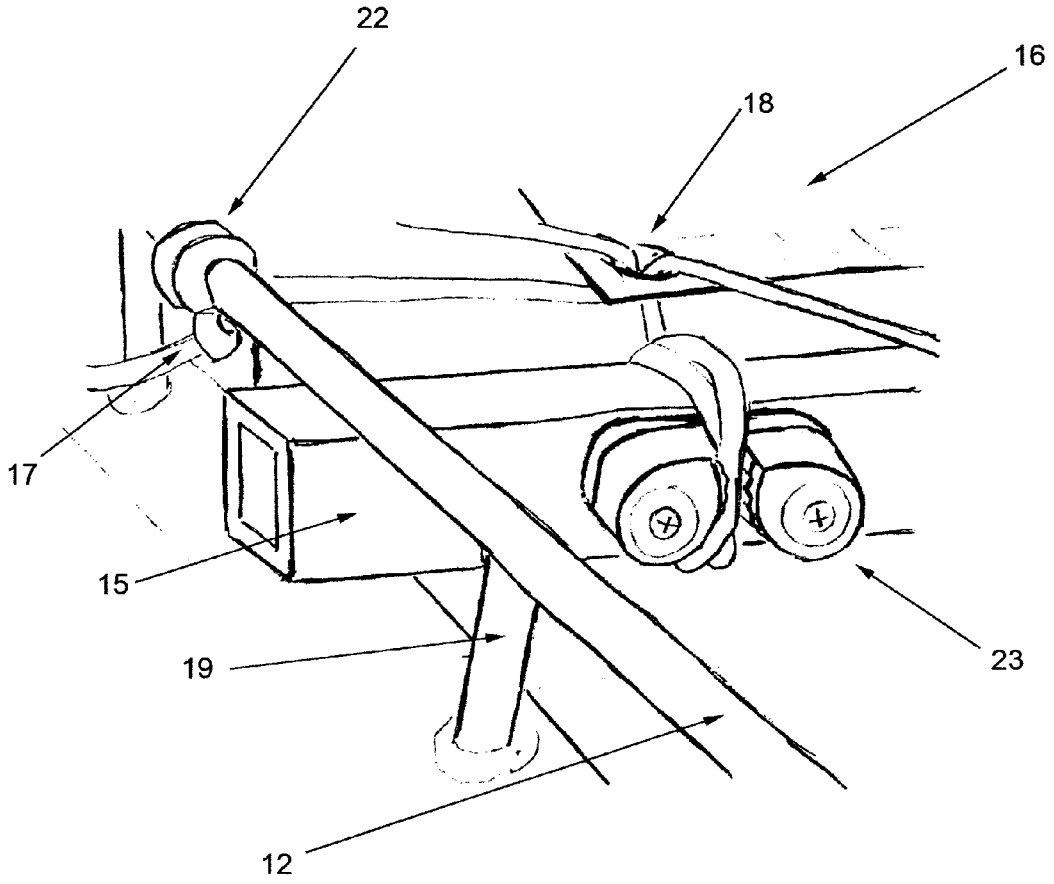
FIG. 3C depicts another close up view of a portion of the trampoline of the present invention.

FIG. 3C illustrates another close up view of trampoline 16 and its connection between frame 15 and boat rail 12. In a preferred embodiment, rope 17 is inserted through grommets 18 and weaved around frame 15 and rail 12. When securing trampoline 16, one side of rope 17 is secured to either frame 15 or rail 12 with a knot 22 as illustrated in FIG. 3C. Knot 22 may be any type of knot that will secure rope 17 to rail 12 or frame 15. Once one end of rope 17 is secured with knot 22, rope 17 is preferably weaved through grommets 18 and around frame 15 and rail 12. After rope 17 has been weaved and positioned through grommets 18 of trampoline 16 to stretch trampoline 16 out as illustrated in FIG. 3A, then the end of rope 17 opposite knot 22 is secured with the use of cleat 23. Cleat 23 is useful in that is allows a user to quickly secure and unsecure rope 17 at cleat 23 which allows a user to easily move trampoline 16 should the user need to move trampoline 16 for any reason, such as accessing items stored underneath trampoline 16. While cleat 23 is preferred, in alternative embodiments, a user may choose to use a second knot instead of cleat 23 to finish securing trampoline 16.

Figure 3D:
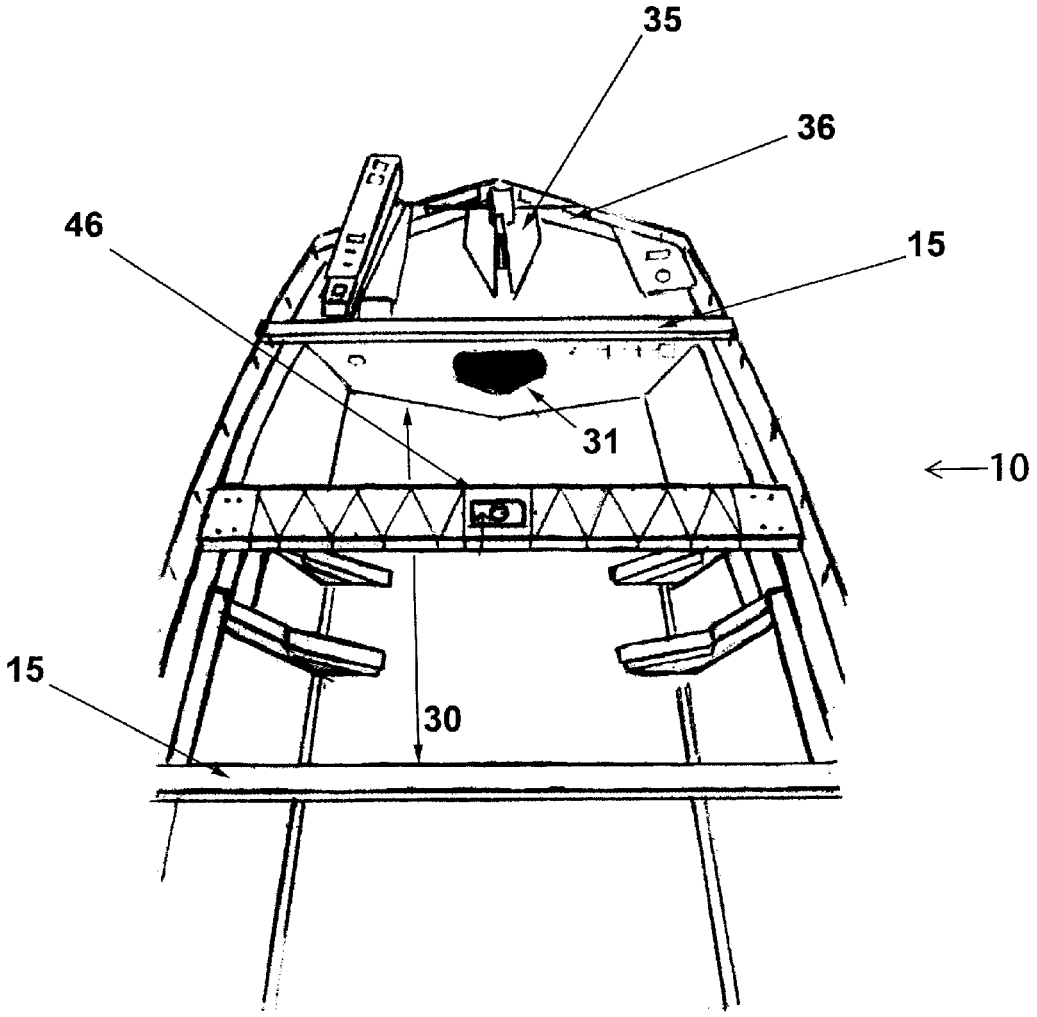
FIG. 3D depicts a close up view of the vessel of the present invention.

In one embodiment of the present invention, as illustrated in FIG. 3D, a support member 40 is located between the members of frame 15 and positioned beneath trampoline 16. While trampoline 16 is not illustrated in FIG. 3D, support member 40 is preferably located about 3 inches below trampoline 16. The 3 inches is not a limitation of the present invention as in other embodiments, the support member 40 may be located closer to or further from trampoline 16. Support member 40 is located beneath trampoline 16 so that when a user is sitting, standing, or laying on trampoline 16, the individual will not have any discomfort from support member 40 protruding into trampoline 16 and into a user that is sitting, standing, or laying on trampoline 16. Support member 40 is preferably connected to and attached to vessel 10. Support member 40 may be attached to vessel 10 in any number of ways, such as a welded connection, screwed connection, bolted connection or other similar connection. In addition, the present invention is also configured with a seat bracket 46 mounted to support member 40. Bracket 46 provides a mounting location for a seat to be used in the present invention, such as a seat routinely used with boats for fishing. Support member 40 also functions to provide support when heavier items are rested upon or are placed on trampoline 16. The present invention is also configured so that a user may easily access and use any seats that are to be connected to seat bracket 46. In a preferred embodiment, trampoline 16 is configured with a hole near bracket 46 so that a seat may be easily connected to bracket 46 through a hole in trampoline 16. In addition, bracket 46 is preferably a quick connection bracket, so that users may quickly and easily connect and remove any seat used with bracket 46.

Figure 3E:
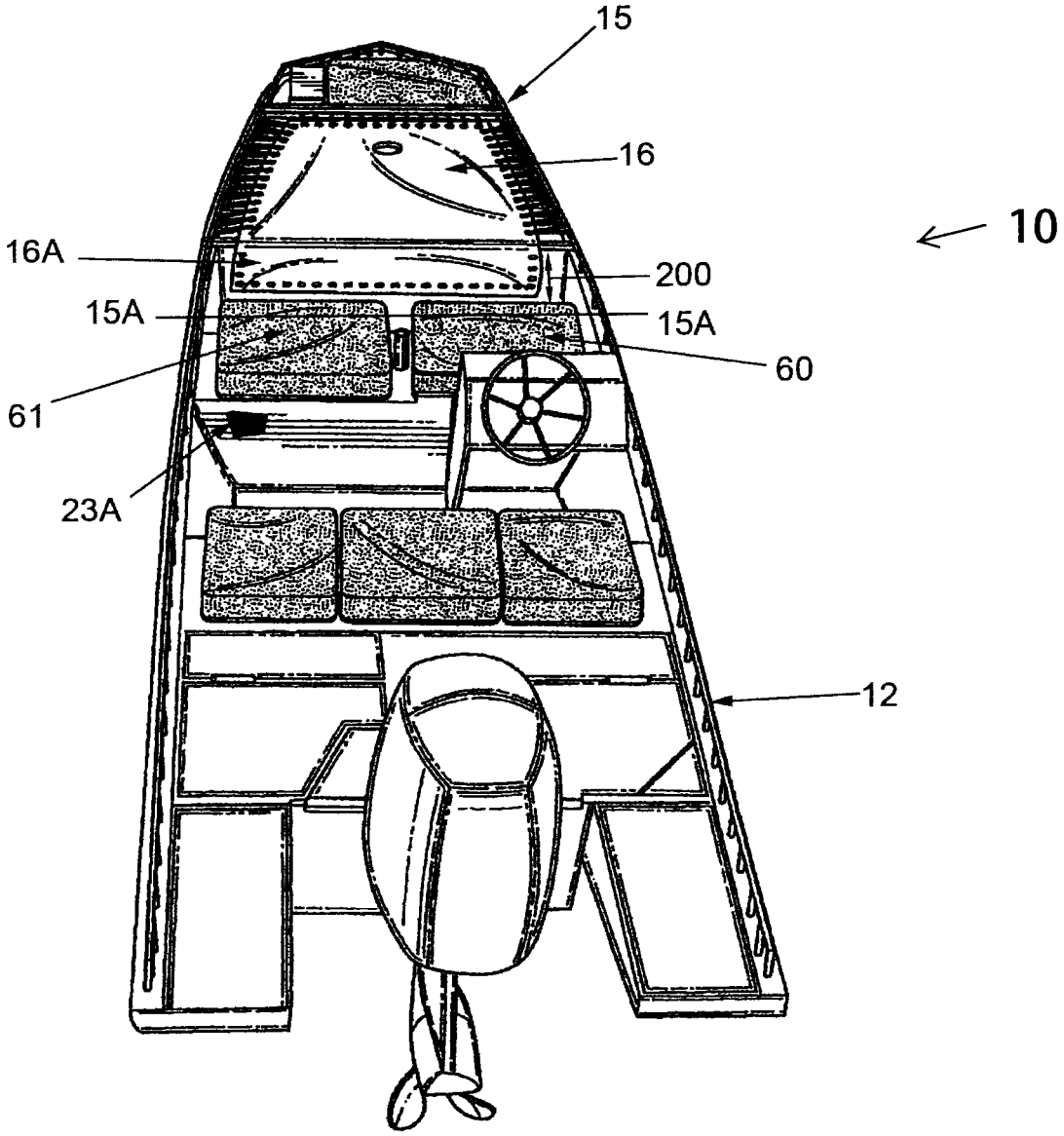
FIG. 3E depicts an overhead view of a vessel of the present invention.

In an alternative embodiment, trampoline 16 may be configured so that it can be quickly and easily extended to increase in length so that it may be used as a resting place for a portion of bodies of passengers who sleep in the present invention. As illustrated in FIG. 3E, in such an embodiment, trampoline 16 includes additional portion 16A that is illustrated hanging down in FIG. 3E. This additional portion 16A is extra trampoline material that hangs down past frame 15 when trampoline 16 is not extended beyond frame 15 illustrated in FIG. 3E. However, in this embodiment, when users are ready to extend the size of trampoline 16, users may take additional portion 16A and extend it out to extended frame member 15A. In such an embodiment, trampoline 16 will preferably not extend over and past seats 60 and 61 but will extend to seats 60 and 61 and at the same height as seats 60 and 61. In other embodiments, additional portion 16A may extend past seats and will connect to extra frame member 15 through the use of rope 17 which will be inserted through grommets 18 and weaved around extra frame member 15A and rail 12. A cleat 23A may also be mounted to the back of seats 60 and 61 so that rope 17 can be easily secured to assist in quickly extending the length of trampoline 16 and taking down the extended portion of trampoline 16.

The present invention may also be configured so that trampoline 16 is replaced with a deck that may be configured with hatches configured in the deck for storage. The hatches preferably contain brackets that allow users to raise and lower any such hatches to access any items in such hatches. In such an embodiment, the deck will be configured to withstand heavier weights than trampoline 16 such that support member 40 will not be necessary. Thus, in using a deck, the present invention may not have support member 40. However, if using a deck instead of trampoline 16, seat bracket 46 will still be used and will be mounted directly to the deck so that a user may use a seat on the deck. In such an embodiment, bracket 46 will be arranged so that bracket 46 may be quickly removed and placed into a storage area so that bracket 46 will not interfere with a user's sleeping area on a deck. In such an embodiment, the deck will preferably be made of aluminum or other reduced weight metal to assist in reducing the overall weight of the present invention.

The present invention may also be configured with many storage locations and cushions to increase the comfort level of individuals utilizing the present invention for over-night and multi-day expeditions. FIG. 3D illustrates a close up view of a section of vessel 10. Particularly, FIG. 3D illustrates the bow or front portion of vessel 10 with trampoline 16 removed. In the present invention, storage is provided for underneath trampoline 16. As illustrated in FIG. 3D, underneath trampoline 16, storage area 30 is preferably located in the front of the boat underneath trampoline 16 and capable of storing any number of items or gear used by a user when the present invention is in use. In a preferred embodiment, the portion of front storage 30 located in front of support member 40 is configured to store any number of items, such as water and in the bow of vessel 10 below trampoline 16 there is also room to store anchor rope 31 associated with an anchor for vessel 10. As illustrated in FIG. 3D, vessel 10 is also configured with anchor 35 and with an anchor storage location 36 in the bow of vessel 10 so that anchor 35 may be stored in the front of vessel 10 so as not to interfere with trampoline 16 and to not limit or reduce any storage capacity underneath trampoline 16.

While water may be stored in bladders or in other containers underneath trampoline 16, in one embodiment, the area underneath trampoline 16 behind support member 40 is preferably used to store a user's gear in dry bags, such as sleeping bags, material that will make up the tent discussed herein, pillows, extra clothes, and the like. In a preferred embodiment, the storage space underneath trampoline 16 that is behind support member 40 is larger than the area in front of support member 40. However, this configuration is not a limitation as the present invention may be arranged so that the storage space is equal on both sides of support member 40. In addition, the present invention is configured as a self-contained camping vessel with water from said bladders, a toiled preferably stored underneath seats 300, 310, or 320 as illustrated in FIG. 3A. In such an embodiment, said water bladders are connected to a pump for circulating water throughout the vessel so that as a user needs water, they may have instant access to fresh water with the use of such a pump. The pump also increases the convenience of the present invention when used as a self-contained camping vessel.

As illustrated in FIG. 3A, the present invention may be configured with a bow cushion 50 to provide cushion for anyone sitting on the bow of vessel 10 and to also provide cushion when users are sleeping on vessel 10 as will be illustrated herein. The present invention is also preferably configured with storage location under seat 50. As illustrated in FIG. 3D, anchor 35 is stored in the bow of vessel 10 beneath seat 50. Vessel 10 may also be configured so that any number of other items may be stored underneath seat 50. As illustrated in FIG. 3A, vessel 10 may be configured so that any supports in the bow of vessel 10 are configured in a manner that allows for free space 51 to be used as storage of various items in the bow to provide for additional storage space for users of the present invention. Free space 51 illustrated in FIG. 3A may be used to store various items, such as a water bladder, that can be stored in the bow of vessel 10 beneath seat 50 in free space 51. The storage of a water bladder in space 51 is advantageous as it assists in balancing vessel 10. Storage under seat 50 is not limited to a water bladder as other items may also be stored under seat 50 in the bow of vessel 10.

The present invention is also configured with seats 60 and 61 located near the middle of vessel 10 as illustrated in FIG. 3A. Seats 60 and 61 are preferably flotation seats that can be used by passengers in the event that flotation devices are needed. In one embodiment, seats 60 and 61 are configured with storage space underneath the seats and are attached to vessel 10 in a manner that allows a user to easily raise seats 60 and 61 to access any items stored underneath seats 60 and 61. In one embodiment, batteries are stored underneath seats 60 and 61 along with any electrical peripheral devices that run off of the batteries such as lights, water pumps, and other electrical devices. The storage location under seats 60 and 61 may also be configured such that these storage locations are isolated and water-proof to keep any batteries or items stored dry.

Figure 4A:
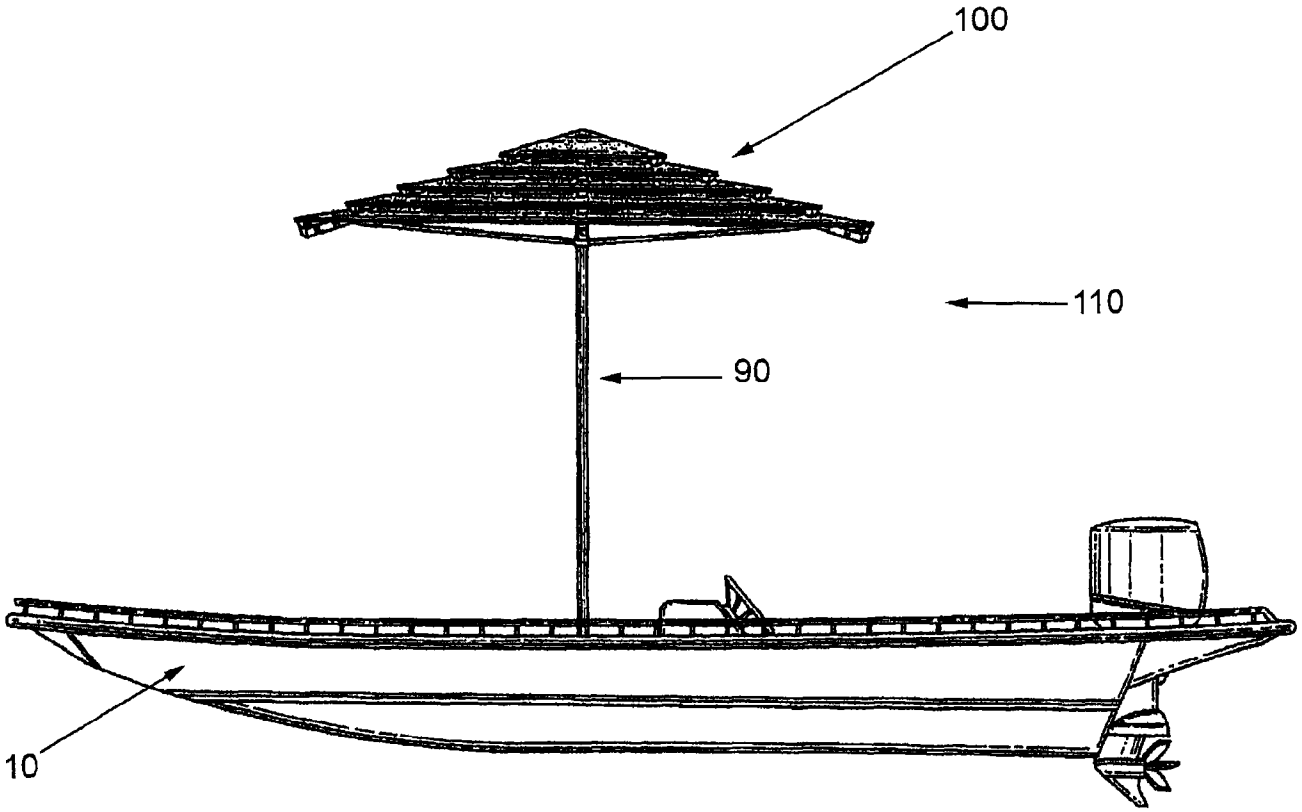
FIG. 4A depicts a side view of the vessel of the present invention with an umbrella-type canopy installed and in an open configuration.

Seats 60 and 61 are preferably mounted on a support structure mounted to vessel 10 so that seats 60 and 61 are stationary. In addition, the present invention is preferably configured with a canopy hole 70 as illustrated in FIG. 3A. Canopy hole 70 provides a space for canopy 110 as illustrated in FIG. 4A to be secured to vessel 10. As illustrated in FIG. 4A, canopy 110 includes pole 90 and umbrella 100. Umbrella 100 is illustrated in an open position in FIG. 4A. Canopy 110 functions to provide shelter from the environment when the present invention is in use, such as shelter from the sun, rain, wind, and the like.

Figure 4B:
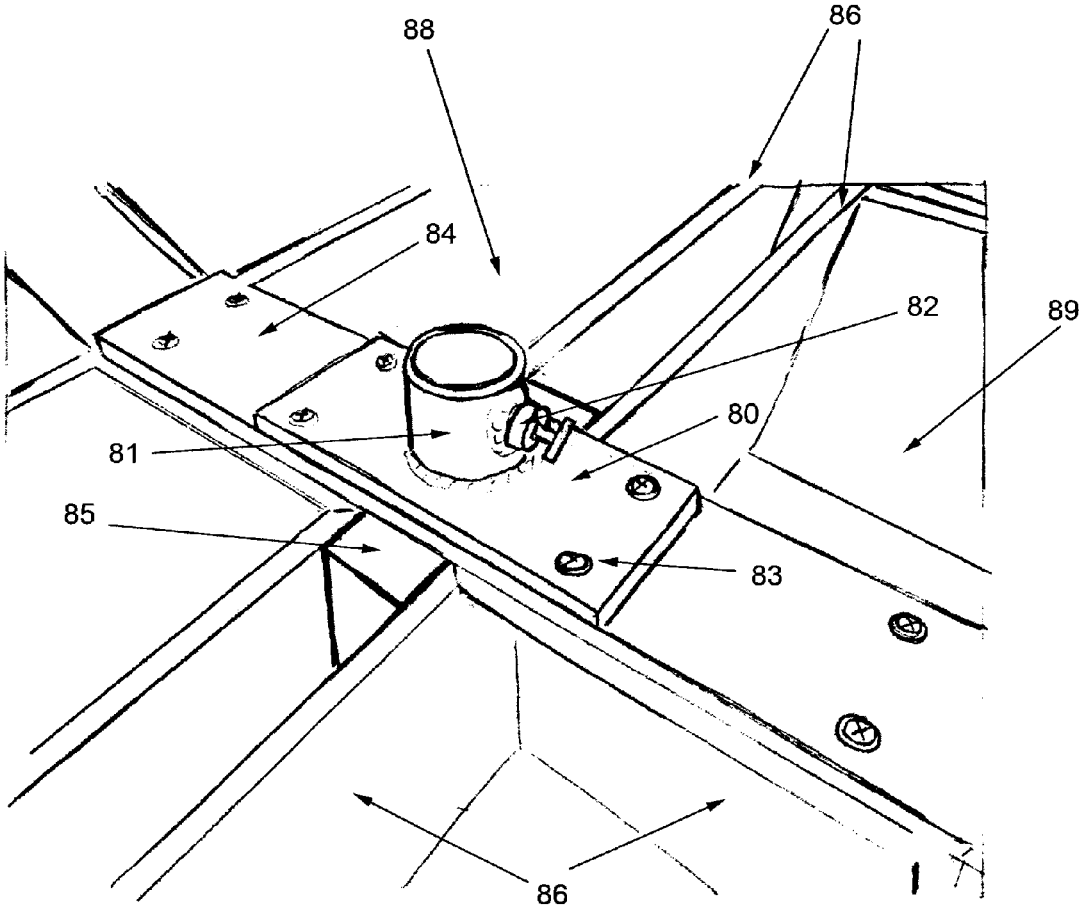
FIG. 4B depicts a close up view of one style of connection of the umbrella-type canopy to the vessel of the present invention.

Hole 70 as illustrated in FIG. 3A provides a location for pole 90 of canopy 110 to slide into and mount to a support system in vessel 10 below seats 60 and 61. In a preferred embodiment, the present invention is configured with truss members 86 that are inserted underneath seats 60 and 61 and between storage areas 88 and 89. Truss members 86 act to provide support to base bracket 80 where pole 90 will be mounted. Truss members 86 may be comprised of wood, metal, plastic fiberglass or other materials. In one embodiment, as illustrated in FIG. 4B, pole 90 of canopy 110 will slide through hole 70 and eventually mount to a base bracket 80. Base bracket 80 preferably includes female member 81 and mounting screw 82. In a preferred embodiment, pole 90 of canopy 110 will slide into female member 81 of base bracket 80. After pole 90 has been positioned into female member 81, then mounting screw 82 is tightened to secure pole 90 to base bracket 80. While base bracket 80 illustrates one mounting screw 82, in alternative embodiments, base bracket 80 may be configured with multiple screws to assist in securing pole 90 to base bracket 80.

In one embodiment, as illustrated in FIG. 4B, base bracket 80 is secured to vessel 10 with mounting screws/bolts 83 that function to mount base bracket 80 to sleeve member 84. Sleeve member 84 is preferably a piece of metal that mounts to truss members 86 and sits on top of blocking member 85. Blocking member 85 is a piece of material that adds support to sleeve member 84 which will in turn provide support to base bracket 80 which will in turn provide support to and strengthen canopy 110 when it is in the open position. In other embodiments, sleeve member 84 may be wood, plastic, fiberglass, or other type of material. In an alternative embodiment, the present invention may be configured so that sleeve member 84 mounts directly to vessel 10, or may be configured to mount to both vessel 10, blocking member 85, and truss members 86.

Figure 4C:
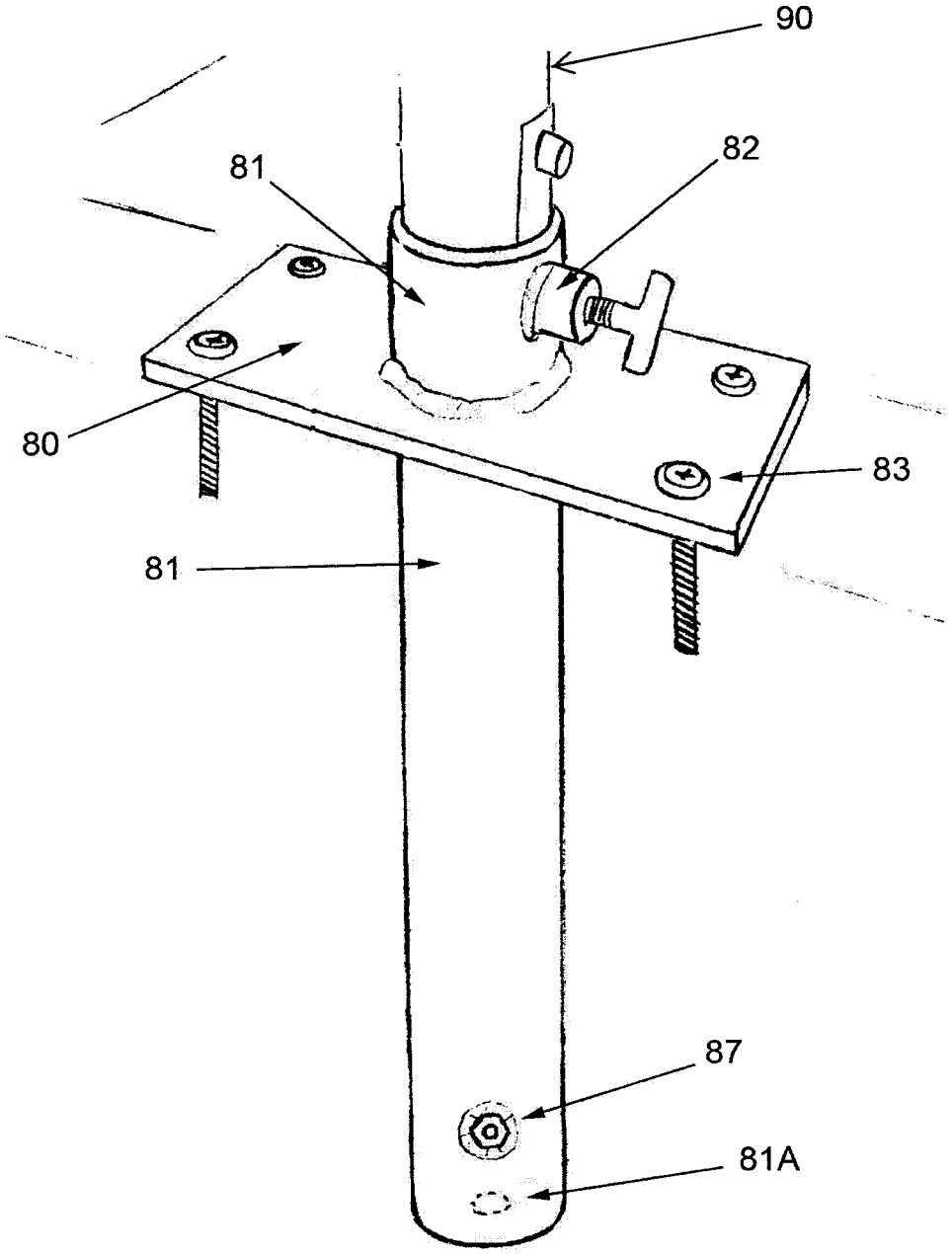
FIG. 4C depicts a close up view of the lower portion of the pole and connection point of the umbrella-type canopy of the present invention.

As illustrated in FIG. 4C, female member 81 of base bracket 80 will extend down to the floor of vessel 10. Female member 81 may be configured with an inside diameter of 2⅛" with pole 90 configured with an outside diameter of 2" so that pole 90 will easily fit into female member 81. Such measurements are merely examples and are not limitations on the present invention. Bracket 80 may also be configured with hole 81A for drainage purposes so that in the event any water accumulates in pole 90 or female member 81, then said water can drain out of hole 81A. The present invention may also be configured with pressure plate 82A that adds pressure and resistance to female member 81 and pole 90 when pole 90 is inserted into female member 81 to assist in securing pole 90 when it is installed into female member 81. In addition, the present invention may be configured with a ground wire bolt 87 for the purpose of grounding female member 81 and providing some protection from shock that may arise from pole 90 or female member 81 or that may arise from lightning that strikes pole 90 or other areas.

Figure 4D:
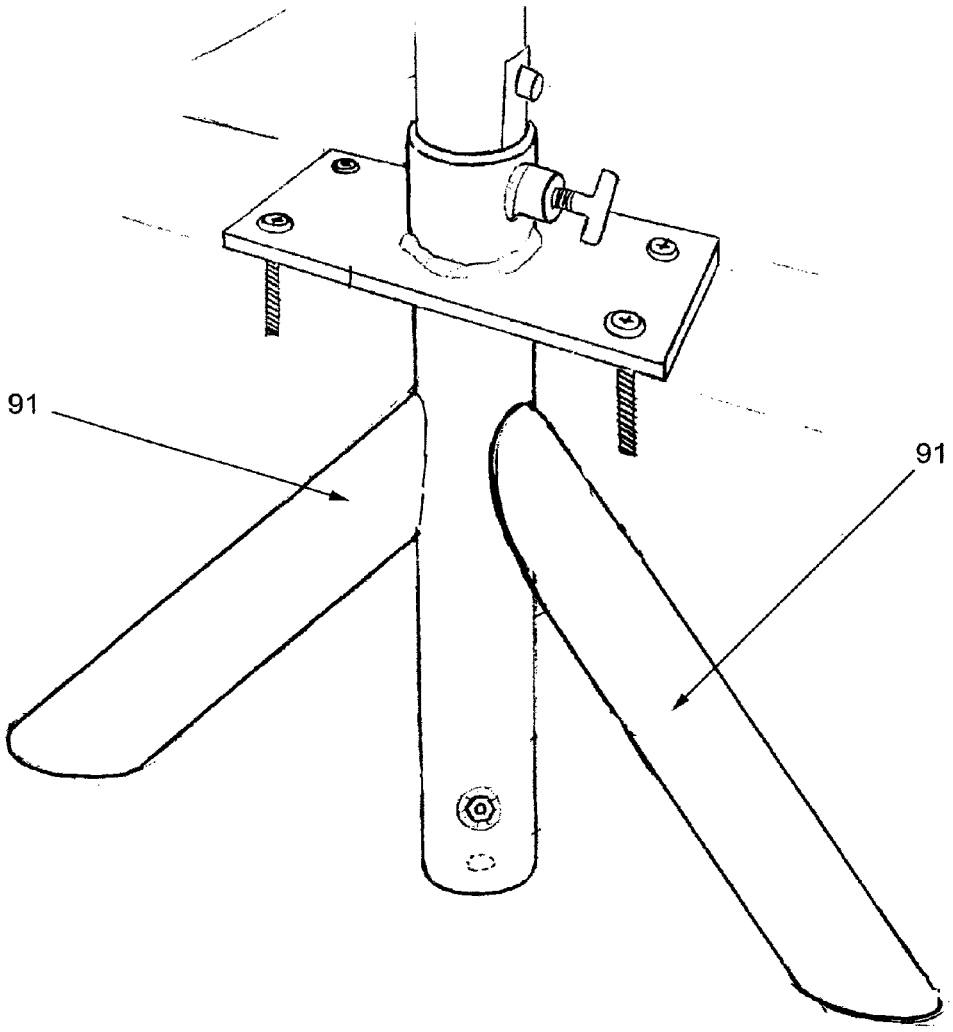
FIG. 4D depicts a close up view of a second style of connection of the umbrella-type canopy to the vessel of the present invention

In an alternative embodiment of the present invention, as illustrated in FIG. 4D, bracket 80 will be secured in place with the use of pipe members 91 that are secured to female member 81 at one end and the opposite end of pipe members 91 are secured to vessel 10. Pipe members 91 are preferably secured to female member 81 and vessel 10 through some type of fastening means such as a permanent weld, screws, or bolts. As illustrated in FIG. 4D, pipe members 91 are positioned so that one pipe member 91 extends down towards the front/bow of vessel 10 and the other pipe member 91 extends down towards the back/stern of vessel 10. FIG. 4D is merely an illustration of one embodiment of the present invention as the present invention may also be configured with additional pipe members that connect to female member 81 at one end and then extend down to the right and left side of vessel 10 to provide additional support to female member 81 which will provide support to canopy 110 and enable vessel 10 to navigate through waters while canopy 110 is open.

The manner in which canopy 110 is mounted to vessel 10 increases the strength and durability of canopy 110 to accommodate added weight. The present invention may also be configured so that canopy 110 can withstand the added weight of solar panels to provide power to users of the present invention. The present invention may also be configured with solar panels to provide electricity as needed by its users. Additionally, the single pole canopy of the present invention provides greater visibility to a captain and all passengers.

FIG. 5A illustrates an end view of the vessel 10 of the present invention with canopy 110 installed and in an open configuration. While not illustrated in FIG. 5A, canopy 110 is inserted into and connected to base bracket 80 through hole 70 illustrated in FIG. 3A. In a preferred embodiment, canopy 110 is configured so that umbrella 100 sized to provide shade and shelter across the width of vessel 10. In a preferred embodiment, canopy 110 may also be configured so that umbrella 100 is sized to provide shade and shelter across a majority of the length of vessel 10 as illustrated in FIG. 6. Canopy 110 is further configured so that it does not obstruct the view of a captain navigating vessel 10 so that canopy 110 may be in the open position while a captain is navigating vessel 10 through the water, preferably marshlands or shallow swampy waters. This configuration also provides clear unobstructed 360 degree view so that passengers can easily fish, take photographs, or partake in numerous other activities without being obstructed by canopy 110.

FIG. 5B depicts a bottom perspective view of canopy 110 with umbrella 100 in an open position. As illustrated in FIG. 5B, umbrella 100 is preferably a multi-vent umbrella with multiple layers that allow for improved air flow. In one embodiment, umbrella 100 includes multiple layers illustrated by layers 101, 102, 103, and 104 in FIG. 5A. These layers making up umbrella 100 are preferably comprised of a weather resistant fabric/material, such as olefin, Teflon based fabric, polyester, marine canvas, Sunforger canvass, Sunbrella Marine fabric, an industrial vinyl, a polyethylene based fabric or other similar material. Umbrella 100 is also configured with spacing 105 between layers 101, 102, 103, and 104. Umbrella 100 is configured with spacing 105 present in 360 degrees between each layer of umbrella 100. Spacing 105 allows air to pass through in all directions preventing canopy 110 from becoming a sail in high wind conditions and also acts to reduce drag when a captain is operating vessel 10 at full speed with umbrella 100 of canopy 110 in an open position. A user can navigate vessel 10 with umbrella 100 in an open position as the spacing 105 of umbrella 100 allows wind encounter from navigating vessel 10 to flow through the spacing 105. Spacing 105 also provides ventilation when the present invention is configured with the tent in an open configuration as discussed herein.

Figure 5C:
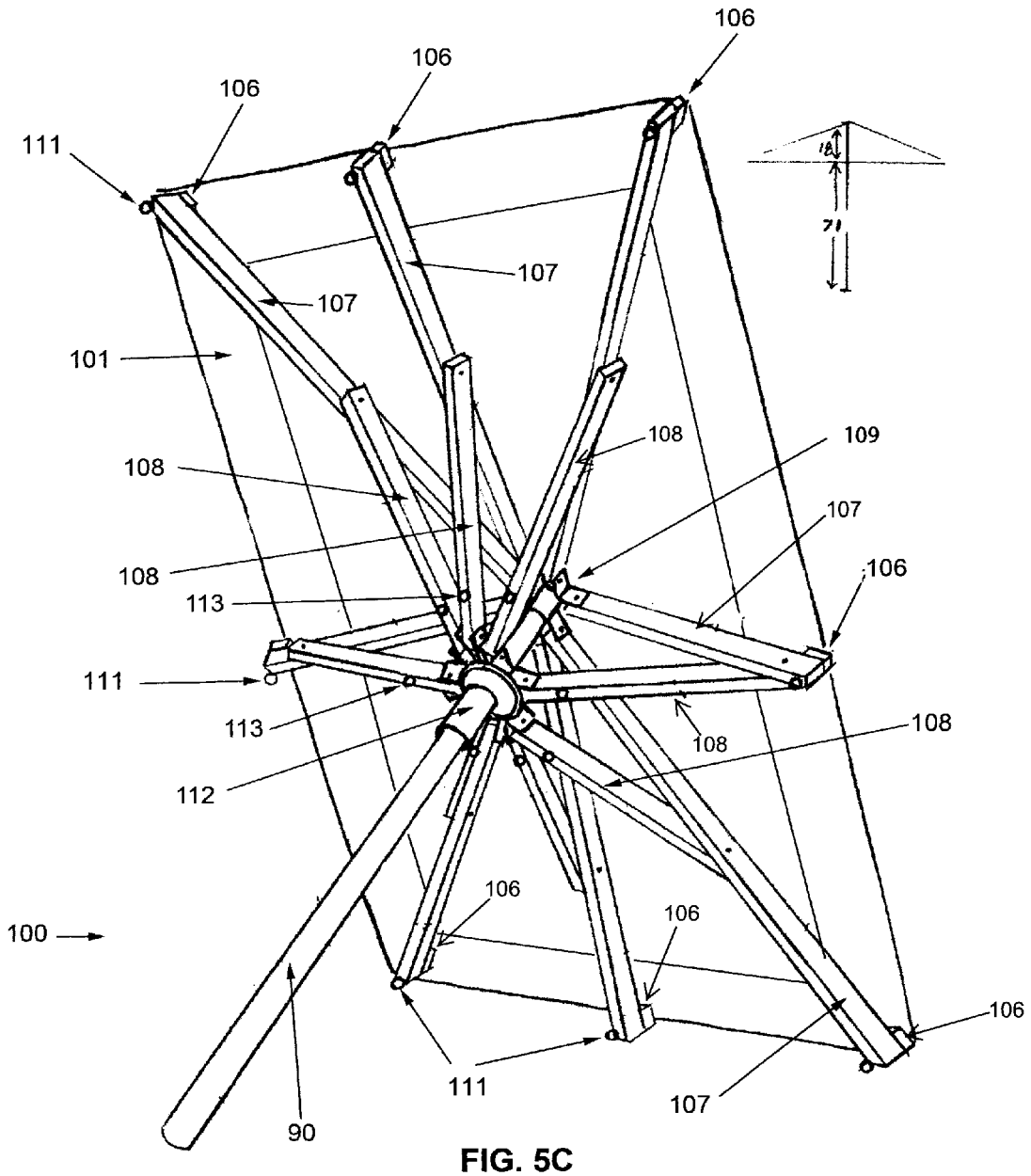
FIG. 5C depicts a perspective view of the underside of an umbrella-type canopy of the present invention in an open configuration.
Figure 6:
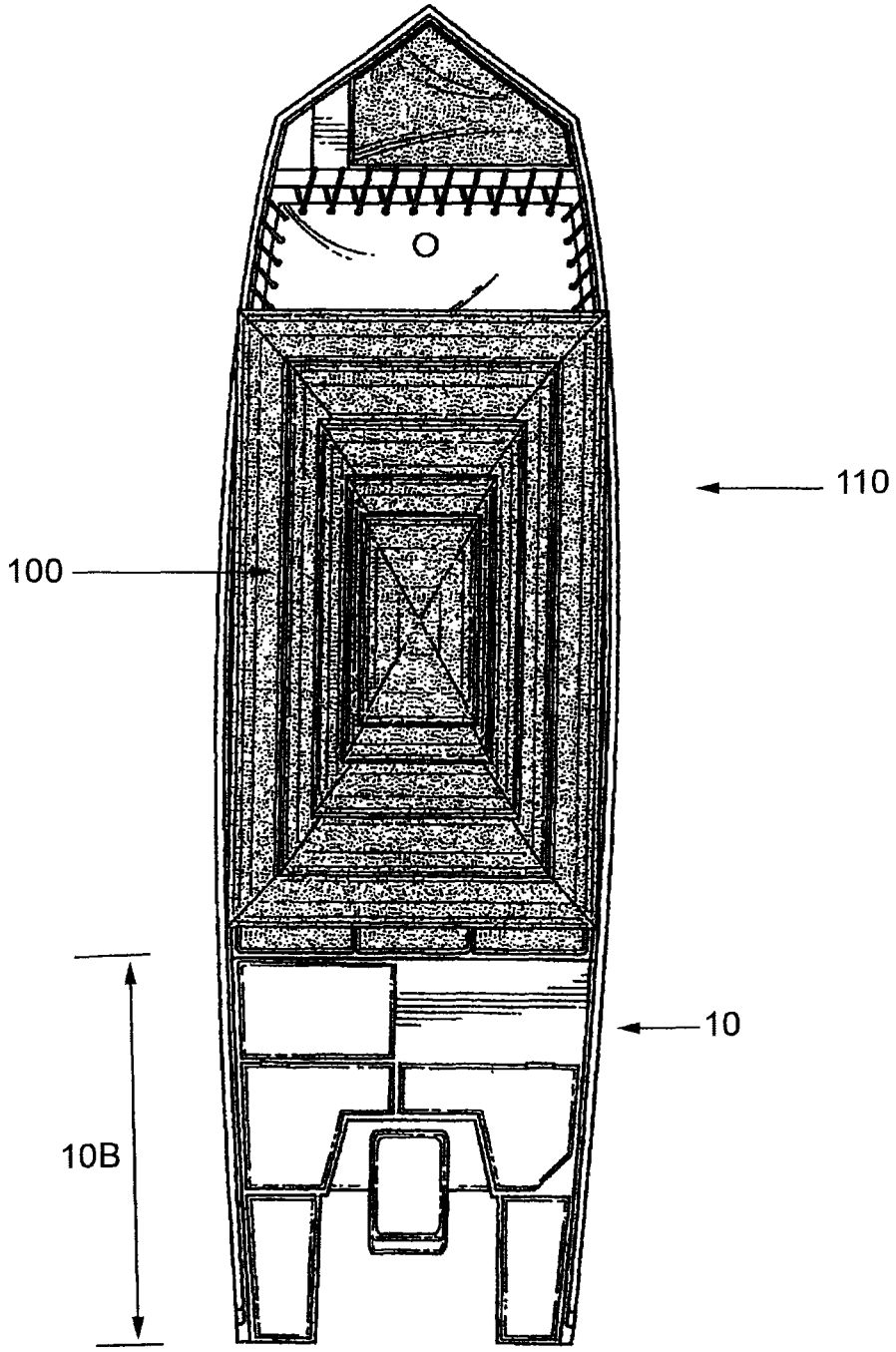
FIG. 6 depicts an overhead view of the vessel of the present invention with an umbrella-type canopy installed and in an open configuration.

FIG. 5C illustrates a close up view of the underside of umbrella 100 and layer 101. As illustrated, umbrella 100 is preferably configured with multiple spacer blocks 106 that are located between upper canopy arms 107 and layer 101 of umbrella 100. Spacer blocks 106 add space between upper canopy arms 107 and layer 101 so that air may flow layer 101 and assist with preventing a sail effect and in reducing any drag effect when a captain is navigating vessel 100 with canopy 110 in an open position.

As illustrated in FIG. 5C, the frame of umbrella 100 is primarily made up of a series of upper canopy arms 107 and inner canopy arms 108. Upper canopy arms 107 are attached to pole 90 of canopy 110 at connection mechanism 109 at the top of pole 90. Connection mechanism 109 is configured so that upper canopy arms 107 can move up and down so that umbrella 100 of canopy 110 may be opened and closed. Connection mechanism 109 may be configured to permanently connect to the top of pole 90 with a plurality of members that allow for upper canopy arms to connect to mechanism 109 at illustrated in FIG. 5D. The opposite end of upper canopy arms 107 is attached to layer 101 and spacer blocks 106 through bolts 111 as illustrated in FIG. 5C. Bolts 111 may be any type of screw, bolt or fastening means that acts to secure upper canopy arms 107 to spacer block 106 and layer 101. In a preferred embodiment of the present invention, bolt 111 is an eye bolt whereby bolt 111 is positioned with the loop portion of the eye bolt on the outer side of layer 101 away from upper canopy arms 107. With bolt 111 positioned in such a manner, a user is able to attach carabiners and other items to bolt 111 to give greater flexibility as to the use of canopy 110.

In a preferred embodiment, inner canopy arms 108 are positioned in a manner such that one end of each inner canopy arm 108 is attached to an upper canopy arm 107 and the opposite end of each inner canopy arm 108 is attached to slide sleeve mechanism 112. Inner canopy arm 108 may be attached to an upper canopy arm through any number of fastening means, such as a screw, bolt, or similar means. Slide sleeve mechanism 112 operates in a manner that will enable umbrella 100 to open and close when force is applied to slide sleeve mechanism 112 when it is pushed up and pulled down. When slide sleeve mechanism 112 is pushed or pulled down it will ultimately pull inner canopy arms 108 down that will ultimately pull down on upper canopy arms 107 and ultimately close umbrella 100. And when slide sleeve mechanism 112 is pushed upward when umbrella 100 is closed, inner canopy arms 108 will be pushed from its downward position to an upward position that will ultimately push upper canopy arms 107 upward which will ultimately open umbrella 100.

The present invention may also be configured with various eye bolts 113 secured to inner canopy arms 108 with the loop portion of eye bolts 113 located on the underside of umbrella 100 so that users may attach items to eye bolts 113, such as carabiners or any number of items preferably when the umbrella 100 of canopy 110 is in an open position. In a preferred embodiment, carabiners are connected to bolts 113 and used to secure tent 600 to canopy 110.

Figure 5D:
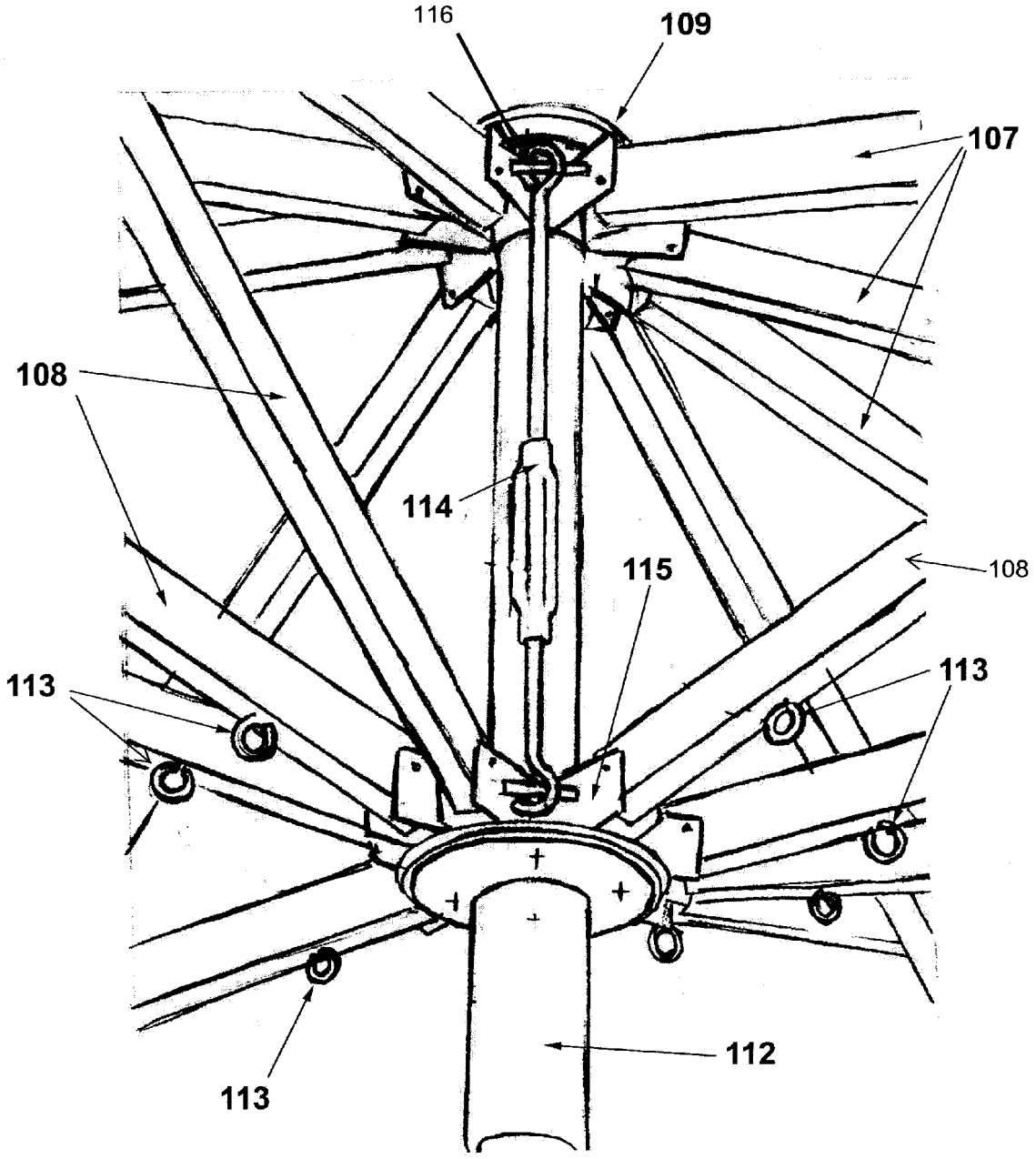
FIG. 5D depicts a close up perspective view of a portion of the underside of an umbrella-type canopy of the present invention in an open configuration.

FIG. 5D illustrates a close up view of slide sleeve mechanism 112 and the various upper canopy arms 107 and inner canopy arms 108. As illustrated in FIG. 5D, an embodiment of the present invention may also be configured to include turnbuckle 114 to control the tension between the interconnections of upper canopy arms 107, inner canopy arms 108, and slide sleeve mechanism 112. Turnbuckle 114 may include a loop on one end and a hook on the other end as illustrated in FIG. 5D. However, the present invention is not limited to this configuration. As illustrated in FIG. 5D, turnbuckle 114 is positioned so that one end is connected to slide sleeve mechanism 112 at connection point 115 and the other side is connected to connection mechanism 109 at connection point 116. Turnbuckle 114 operates to control the tension between the various upper and inner canopy arms and assists in maintaining tension to maintain the structure of umbrella 100 when it is in an open position while a captain is navigating vessel 10. Turnbuckle 114 may also be adjusted as needed to control and maintain structure of umbrella 100. Thus, turnbuckle any effects that the wind may have on umbrella 100 may be controlled with turnbuckle 114 by adjusting turnbuckle 114 to maintain the needed tension between upper arms 107, inner arms 108, slide sleeve mechanism 112, and connection mechanism 109.

FIG. 6 illustrates an overhead view of the present invention with canopy 110 in the open position. As illustrated, canopy 110 may be configured in an embodiment of the present invention to provide shade and shelter to the entire width of vessel 10 and to a majority of the length of vessel 10. An embodiment of the present invention is also configured so that the back section of vessel 10 illustrated as section 10B is not covered by canopy 110 so that a user has some uncovered space to get from under canopy 110 for a number of reasons, such as using the restroom, smoking, getting some "fresh air" not covered by canopy 110, and any other number of reasons.

The present invention is also preferably configured with an open area 210 as illustrated in FIG. 3A. Open area 210 is preferably located behind seats 60 and 61 and in front of seats 300, 310, and 320. In a preferred embodiment, open area 210 is configured to hold an ice-chest with a cushion to provide additional cold storage in the ice-chest and to also provide part of a sleeping area as illustrated by sleeping position 703 in FIG. 10 as discussed herein.

The present invention is also configured with seats 300, 310, and 320 located near the rear of vessel 10 as illustrated in FIG. 3A. Seats 300, 310, and 320 are preferably made such that the seat and/or seat cushion may be removed and used as a flotation device. The present invention is also configured so that seats 300, 310, and 320 are configured with storage area underneath the seats. An embodiment of the present invention may also be configured so that the storage areas underneath seats 300, 310, and 320 are isolated and separated from one another so that different types of items may be stored in the different areas and the different stored items will not cross-contaminate into the other storage areas. For instance, kitchen related items may be stored under seat 300 with bathroom related items stored under seat 310. With these two storage areas isolated, there is no worry of the bathroom related items, such as a toilet and other bathroom items, being cross-contaminated or mixed with the kitchen related items. In one embodiment, a live-well may be located in one of the storage areas under seats 300, 310, or 320. In one embodiment, the storage area under seat 320 may be reserved for the captain's gear including any items that a captain may need to successfully pilot vessel 10 with passengers on board, such as GPS devices, safety equipment, and any other related gear. This configuration of the storage area under seats 300, 310, and 320 is just an example and not a limitation of the present invention. In some embodiments, the storage area under seats 300, 310, and 320 may be configured as one big storage area arranged to store any type of passenger gear or other gear that a user may need.

Figure 8:
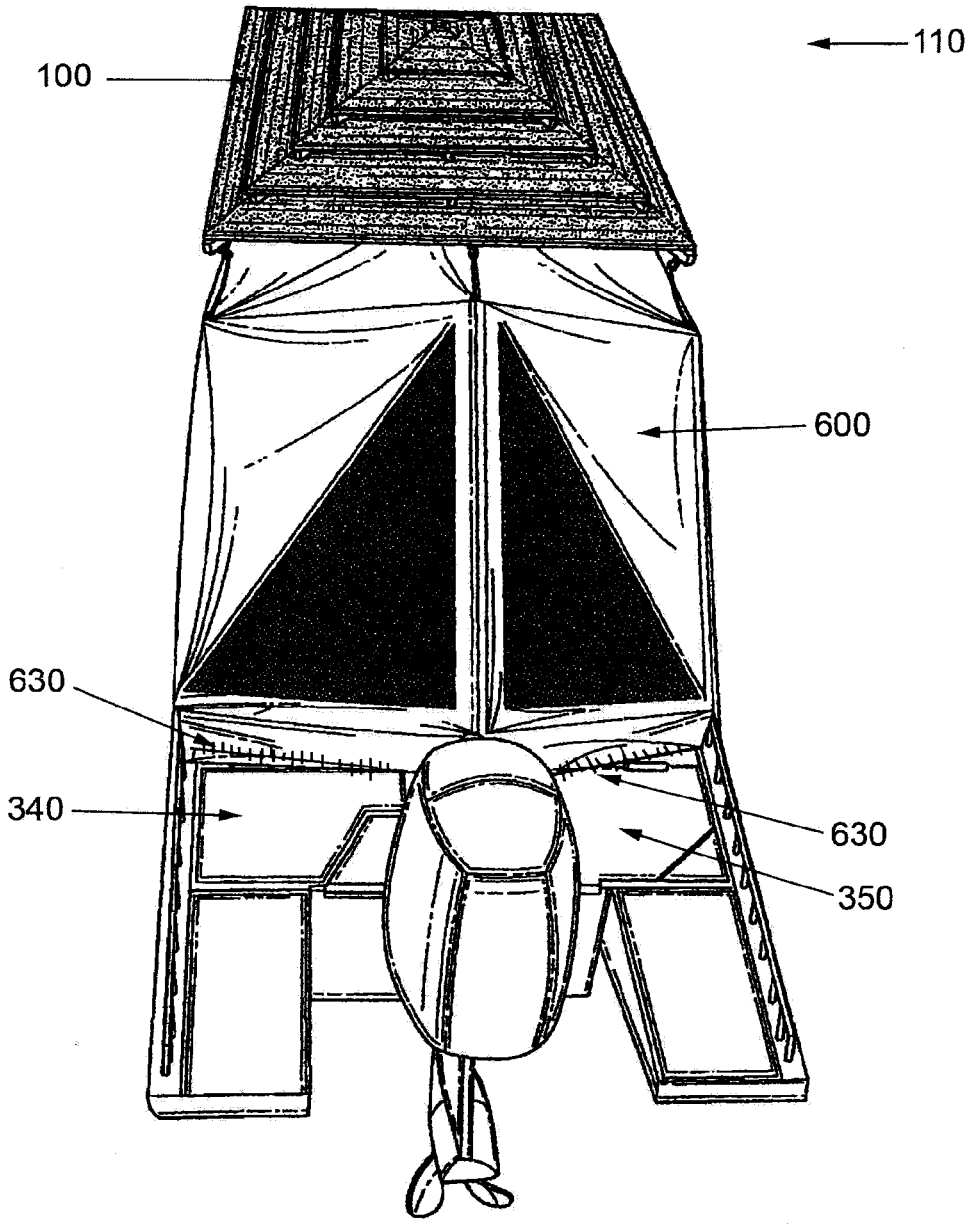
FIG. 8 depicts an end perspective view of the vessel of the present invention with an umbrella-type canopy installed and in an open configuration, and a tent-like shelter in place.

In addition, the present invention may be configured with additional storage areas illustrated as storage areas 330, 340, 350, and 360 located in the rear of vessel 10 as illustrated in FIG. 3A. In one embodiment, storage areas 340 and 350 may be configured with covers and hinges so that a user may simply lift the cover to access any items located in the storage areas. As illustrated in FIG. 8, the present invention is configured so that some storage areas 340 and 350 are located in the rear of the vessel 10 and outside of tent 600. In such a configuration, any flammable materials such as gas and similar items can be stored in storage areas 340 and 350 so that such chemicals are not stored in the tent areas where users will sleep.

While FIG. 3A illustrates storage areas 330-360 as four separate storage areas, this configuration is not a limitation of the present invention as this area of vessel 10 may be configured with more or less storage areas. For example, the present invention may be configured so that there are only two large storage areas located behind seats 300, 310, and 320 as illustrated by storage areas 340 and 350 in FIG. 8.

Figure 7:
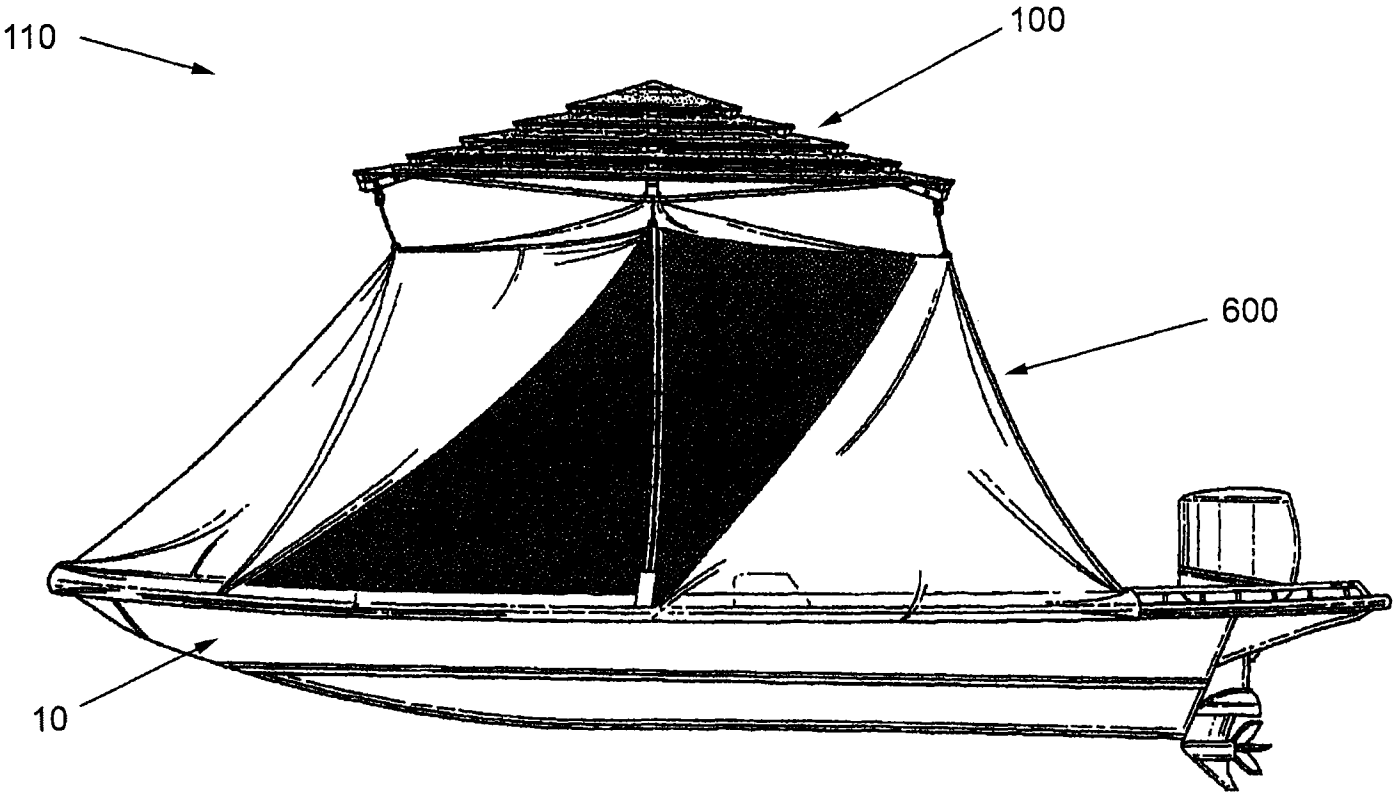
FIG. 7 depicts a side view of the vessel of the present invention with an umbrella-type canopy installed and in an open configuration, and a tent-like shelter in place.

FIG. 7 illustrates a side view of a preferred embodiment of the present invention with tent 600 installed and connected to vessel 10. Tent 600 is configured to connect to umbrella 100 of canopy 110 and flow down to and connect to vessel 10 as illustrated in FIG. 7. In one embodiment, tent 600 is configured to cover the bow of vessel 10 and run to the back of the boat as illustrated in FIG. 7. Tent 600 provides additional shelter to users of the present invention and specifically provides a user protection from rain and moisture to enable a user to explore shallow marshy and swampy waters for extended periods of time, such as overnight and multi-day trips with the protection provided by tent 600 and canopy 110. Tent 600 may be comprise of any number of water-proof fabric such as marine canvas, Sunforger canvass, an industrial vinyl, a polyethylene based fabric or other similar material.

In a preferred embodiment, tent 600 is configured to provide shelter from insects and animals and tent 600 is connected to canopy 110 so that the tent may function as a teepee in that ventilation is provided for through the top of tent 600. In such a configuration, cooking may be performed inside of tent 600 and any fumes or smoke from cooking may ventilate out of the tope of tent 600. In a preferred embodiment of the present invention, any holes provided at the top of tent 600 for ventilation will not allow water to enter tent 600 as any such holes are protected from precipitation and covered by umbrella 100 of canopy 110. In one embodiment, a rope-tensioned web is utilized to attach tent 600 to canopy 110 through the use of carabiners attached to eye bolts 113 that are attached to the inside of umbrella 100 of canopy 110. In one embodiment, rope, such as a double braided polyester rope, runs through tent 600 and attaches to the carabiners that are connected to eye bolts 113 and another portion of the rope will be attached to various hardware clips that are attached to rail 12 of vessel 10. Such configuration creates a tension web of rope that strengthens the tent to withstand strong winds. The tension web also acts to remove tension from the fabric of tent 600 so as to decrease any stress on tent 600.

In one embodiment, tent 600 is configured so that it may be easily stowed away and can be easily set-up/pitched by one person. In addition, the rope-web is configured such that tent 600 may be modified to work with vessels having different size hulls.

FIG. 8 illustrates another back-view of the present invention with tent 600 installed. As illustrated in FIG. 8, in a preferred embodiment, tent 600 does not extend to and cover the entire length of the vessel, but stops just before the back of vessel 10 so that there is some open and uncovered deck of vessel 10. As illustrated in FIG. 8, storage areas 340 and 350 and open and tent 600 does not cover the entirety of vessel 10. This open deck portion of vessel 10 is advantageous as it allows a user to get out of tent 600 and still be on vessel 10 without having to get off of vessel 10 to get from underneath tent 600.

Figure 9:
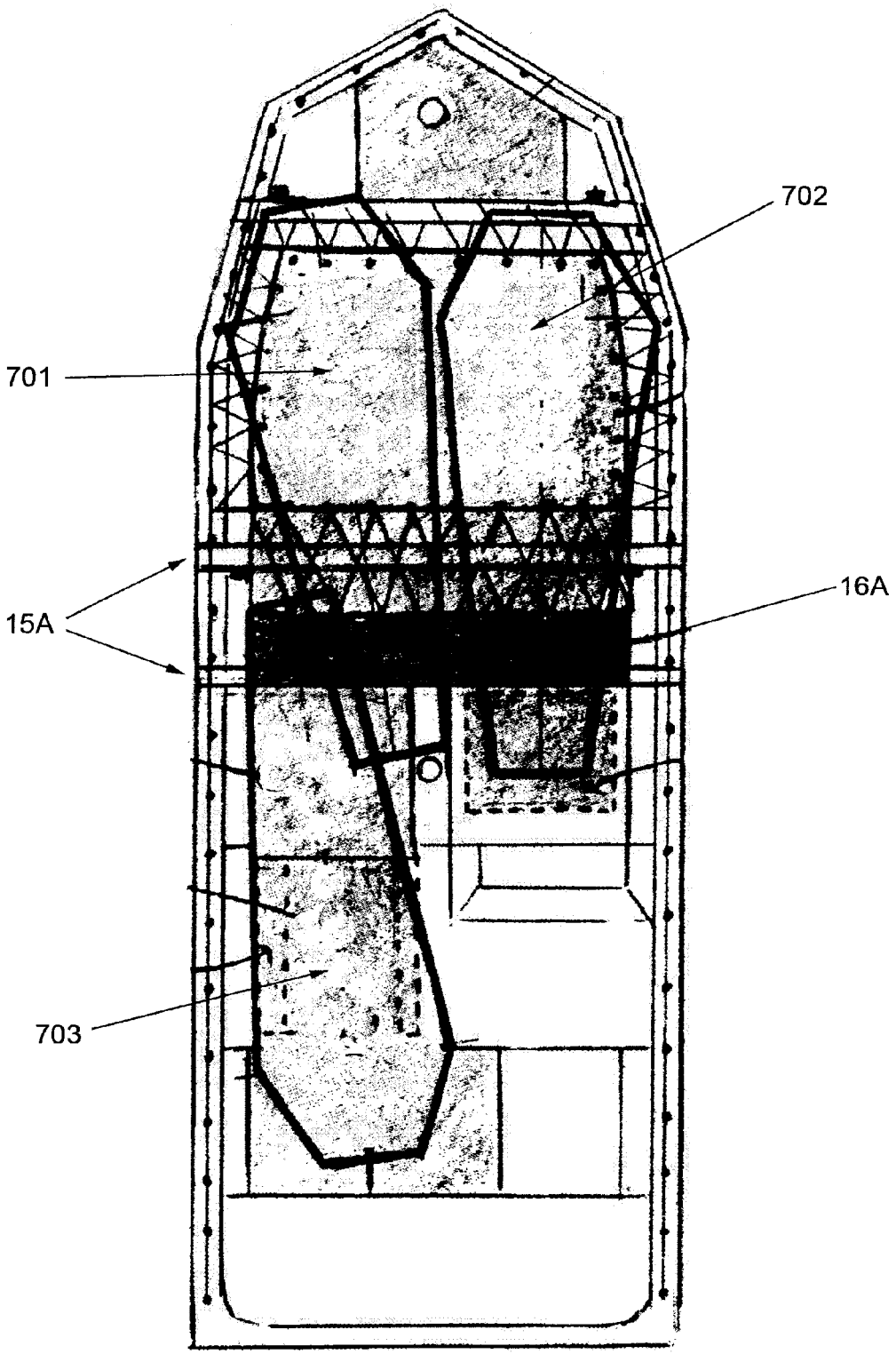
FIG. 9 depicts a perspective view of the sleeping configuration/layout in the present invention.

FIG. 9 illustrates a sleeping layout under tent 600 for three passengers on vessel 10. As illustrated in FIG. 10, the three sleeping layouts/positions are illustrated by positions 701, 702, and 703. In the embodiment illustrated in FIG. 9, additional portion 16A of trampoline 16 has been temporarily extended and attached frame members 15A to provide a rest area for individuals sleeping on positions 701, 702 and 703. In the illustrated positions, position 702 will lay on trampoline 16 and partly on seat 60. Position 701 will lay on trampoline 16 and partly on seat 61. Position 703 will lay on seats 300 and 301, partly on an ice chest placed in position 210, and partly on seat 61 that is shared with position 701. For position 703, a cushion is preferably taken from an empty seat and placed on top of the ice chest placed in space 210 to add comfort to sleeping position 703.

The present invention is configured so that tent 600 may be "pitched" with the natural movement of canopy 110. In such an embodiment, tent 600 can be connected to canopy 110 so that when canopy 110 is moved to an open position tent 600 is "pitched" and placed into a fully "pitched" configuration as illustrated in FIGS. 7 and 8.

Figure 10A:
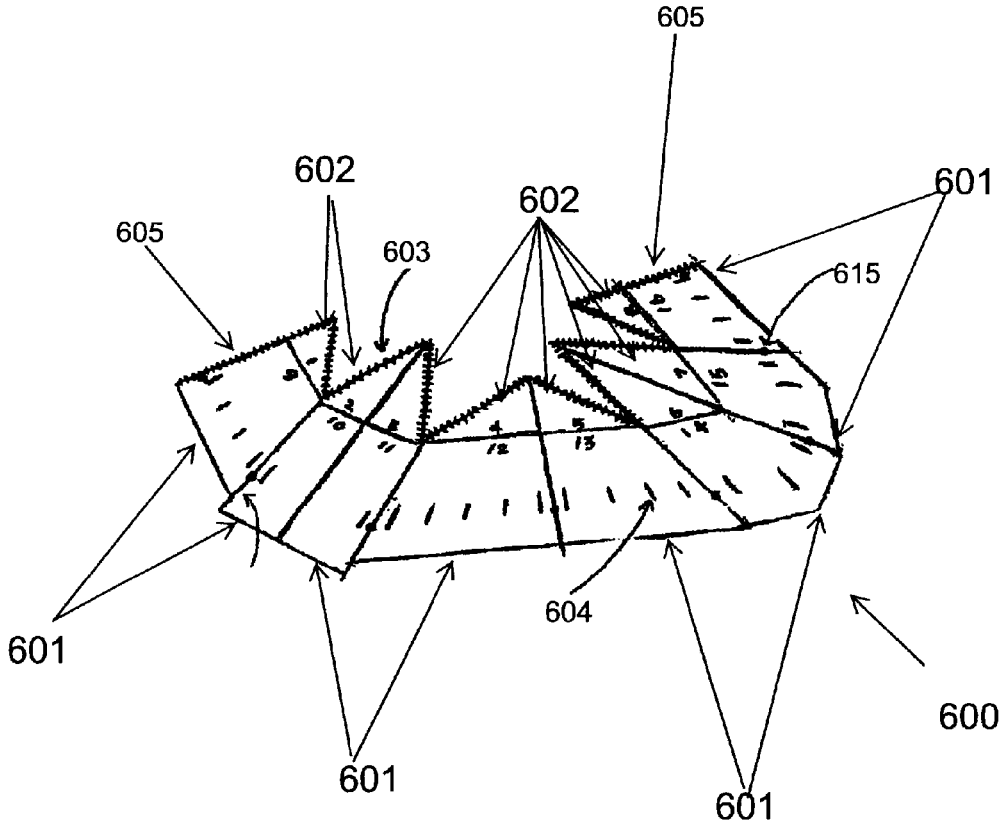
FIG. 10A depicts a flat layout of the tent-like shelter of the present invention.

In a preferred embodiment, the present invention is configured so that tent 600 is configured without the use of poles or rigid structures but is configured with the use of a tension web of rope or other similar material. FIG. 10A illustrates flat layout of tent 600 whereby tent 600 is not in an enclosed configuration. In one embodiment, as illustrated in FIG. 10A, tent 600 may be comprised of a plurality of lower pattern sections 601 and a plurality of upper pattern sections 602. While FIG. 10A illustrates 16 sections, the present invention is not limited to any particular number of pattern sections and in different embodiments, tent 600 may be comprised of more or less than 16 sections. The upper pattern sections 602 are preferably configured with zippers 603 that function to connect the upper sections 602 to one another and also allow a user the ability to disconnect sections 602 from one another so that a user may fold sections 602 inward or outward. The use of zippers 603 on the upper sections is key in that it allows users to configure tent 600 to act as a teepee where the top of the tent 600 can be configured in an open configuration so that tent 600 acts as a teepee with an opening in the top of tent 600 to allow for ventilation out of tent 600.

Figure 11:
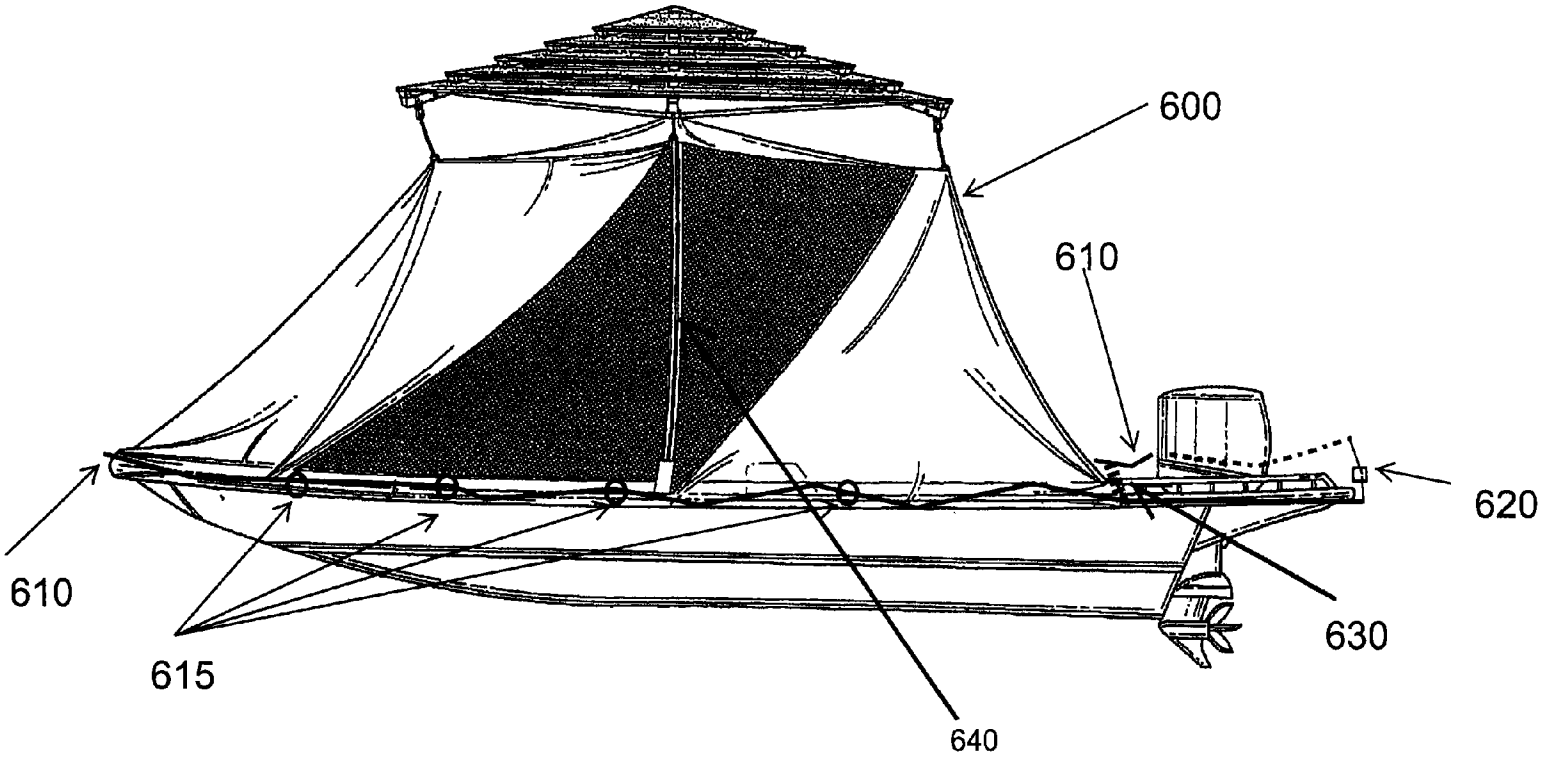
FIG. 11 depicts a side view of the vessel of the present invention with the tent-like shelter in place with a rope securing the tent-like shelter to the vessel.

Lower pattern sections 601 are also configured with grommets 615 located throughout various sections of lower sections 601 that are utilized in securing the lower portion of tent 600 to vessel 10 as further discussed and illustrated in FIG. 11. Lower pattern sections 601 may also be configured with loops 604 that may be used to hold tie downs, such as Velcro straps, to further assist in securing tent 600 to vessel 10. While FIG. 10A illustrates the use of loops 604, the use of loops 604 is not a limitation as the present invention may be configured without the use of loops 604.

Figure 10B:
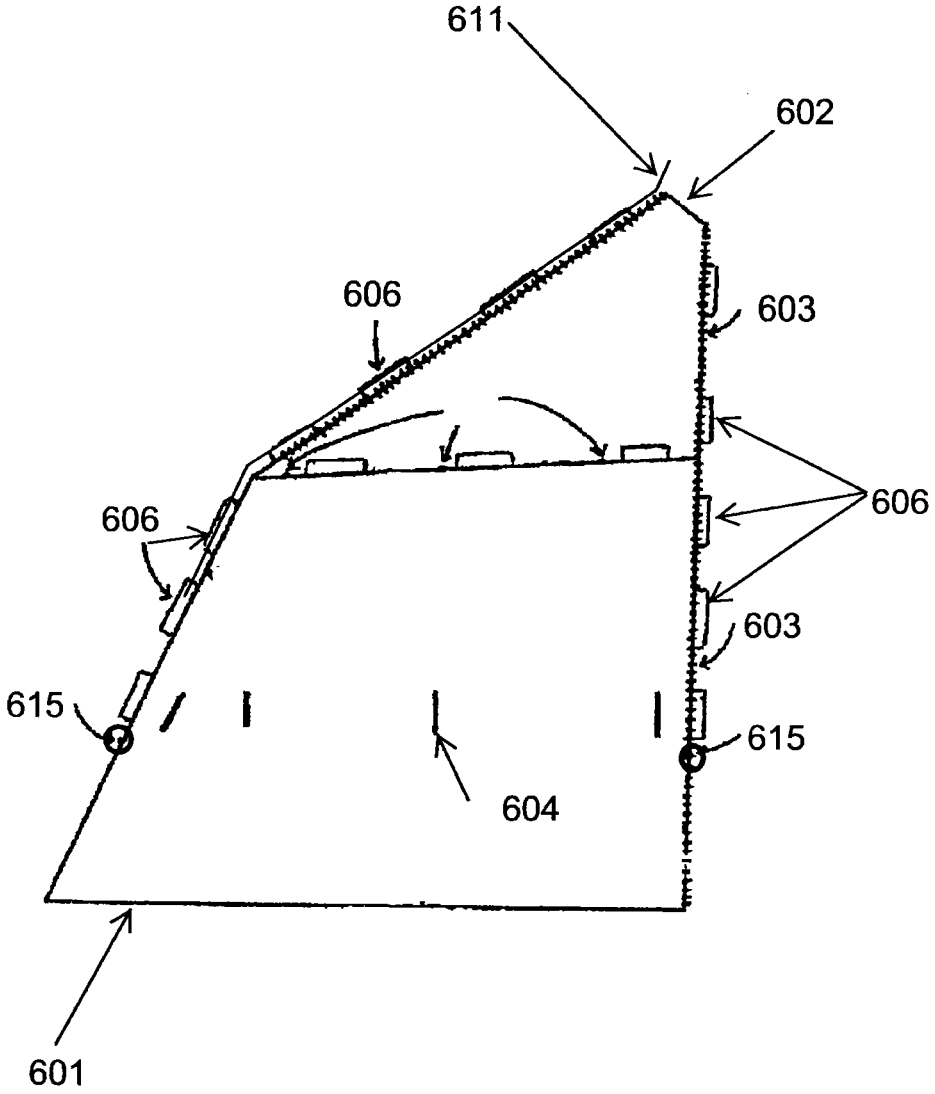
FIG. 10B depicts a flay layout of one portion of the tent-like shelter of the present invention.

End sections 605 of tent 600 as illustrated in FIG. 10A, indicate where the various sections of tent 600 can be connected to one another to convert the tent in the flat configuration as illustrated in FIG. 10A to a tent in a closed configuration as illustrated in FIG. 11. FIG. 10B illustrates a section of tent 600 with both a lower pattern section 601 and upper pattern section 602. In addition, the individual section illustrated in FIG. 10B illustrates loops 604 and grommets 615. In a preferred embodiment, the sections of tent 600, such as lower pattern sections 601 and upper pattern sections 602, are configured with various tubes 606 located on the outside of the pattern sections 601 and 602 as illustrated in FIG. 10B. Tubes 606 provide a location through which a tension-web rope 611 can pass through as illustrated in FIG. 10B. Tension web-rope 611 is preferably a double braided polyester rope where the ends of each piece of tension-web rope 611 are configured with rope crimps, such as a copper or stainless steel crimp, to form a loop at the end so that the ends of each piece of tension-web rope 611 may be connected to fasteners of other components, such as carabiners, so that the rope 611 may ultimately be attached at the top and bottom of tent 600 and hold the tent 600 in a pitched configuration.

The present invention is configured so that tension-web rope 611 is routed through the various tubes 606 that are located on the pattern sections 601 and 602. In a preferred embodiment, tension-web rope 611 is configured to run through all tubes on each side of the pattern sections 601 and 602 toward the top of tent 600 so that when tension-web rope 611 is at the top of tent 600 that end of tension-web rope 611 can connect to the loop portion of eye bolts 113 located on the underside of umbrella 100, as illustrated in FIG. 5D, with the use of carabiners or other securing means. In one embodiment, the tension-web rope 611 may be tied directly to eye bolts 113. The present invention may be configured with tension-web rope 611 configured into multiple pieces that run through all of the tubes 606 at the location where the various sections 601 and 602 connect to form a complete tent as illustrated in FIG. 10A. Thus, as the various pieces of tension-web rope 611 are routed through tubes 606 at the points of connection of the various sections 601 and 602 of tent 600, the pieces of tension-web rope 611 will connect to the eye bolts 113 so that the tent 600 will be connected to umbrella 100 all the way 360 degrees around tent 600. The opposite ends of tension-web rope 611 may connect to the rail 12 of vessel 10 to help secure the bottom end of tent 600 to vessel 10. Thus, tension-web rope 611 will act to secure the top of tent 600 to umbrella 100 at eye bolts 113 and the bottom of tent 600 to vessel 10. In one embodiment, the end of tension-web rope 611 near the bottom of tent 600 may be configured to connect to both rail 12 of vessel 10 and a lower tension rope system 610 illustrated in FIG. 11 that also secures the bottom of tent 600 to vessel 10 as discussed herein.

With the use of tension-web rope 611, a user can easily pitch tent 600 by simply moving umbrella 100 to an open configuration. In a preferred embodiment, a user will route tension-web rope 611 through tubes 606 and connect the pieces of tension-web rope 611 to eye bolts 113 which will effectively connect tent 600 to umbrella 100. After these connections are made, a user can simply lift umbrella to an open position which will cause eye bolts 113 to raise which in-turn will pull up on tension-web rope 611 that will "pitch" tent 600 when umbrella 100 is in an open position.

The present invention is also configured so that tent 600 is secured to vessel 10 through the use of a lower tension rope system that secures the bottom of tent 600 to vessel 10. As illustrated in FIG. 11, lower tension rope system 610, which includes some type of rope, such as a sail rope, runs through the bottom of tent 600. In a preferred embodiment, tent 600 is configured with grommets 615 located in the bottom of tent 600 and tension rope system 610 will be weaved throughout the various grommets located in the bottom of tent 600. The location and illustration of grommets 615 in FIG. 11 is not a limitation of the present invention as grommets 615 may be located in other locations of tent 600. At various locations along vessel 10, a fastening mechanism will be used to hook onto rope system 610 and to hook onto rail 12 of vessel 10. In some embodiments, the fastening mechanism may be a carabiner that will hook onto the grommets of tent 600, hook onto rope system 610, and then hook onto rail 12 of vessel 10. As illustrated in FIG. 11, rope system 610 runs through both sides of tent 600 towards the back of vessel 10 as illustrated by rope system 610 such that two ends of rope system 610 meet towards the back of vessel 10. In addition, the present invention may also be configured with a second fastening mechanism 620 that will secure the two ends of rope system 610 that meet at the back of vessel 10. In one embodiment, second fastening mechanism 620 may be some type of strap or ratchet system that acts to add tension to and secure the two ends of rope system 610 to one another which ultimately will securely hold rope system 610 and tent 600 to the bottom of vessel 10. The present invention is also configured in one embodiment so that rope system 610 will run under the gunwale of vessel 10 so that when rope system 610 is tightened with second fastening mechanism 620, rope system 610 will secure tent 600 to vessel 10 as the rope system 610 cannot roll over gunwale of vessel 10 due to the tight tension from 620.

In addition to second fastening mechanism 620, the present invention may also include a third fastening mechanism 630 that is located at the back of tent 600 where tent 600 stops just before storage areas 340 and 350 as illustrated in FIGS. 8 and 11. The third fastening mechanism 630 acts to secure the back end of tent 600 to vessel 10. In a preferred embodiment, third fastening mechanism may be some type of hook and loop fasteners, such as Velcro, whereby one end of the hook and loop fasteners is securely fastened to the bottom of tent 600 and the other end is securely fastened to vessel 10. Thus, when users are ready to enter tent 600, third fastening mechanism 630 can be secured so that there is a tight seal between tent 600 and vessel 10 to further protect users in tent 600 from the outside environment. This embodiment of the present invention including the tension rope system 610, second fastening mechanism 620, and the third fastening mechanism 630 to jointly secure tent 600 to vessel 10 is advantageous as it tightly secures tent 600 to vessel 10 so that users are protected from outside nuances in the surrounding environment. For instance, if the present invention were used in a swamp rom marshy environment, with tent 600 securely fastened to rail 12 of vessel 10, a user is protected from mosquitos, snakes, and other nuances that could possibly interfere with a user's peaceful occupation of and resting inside of tent 600.

The use of tension-web rope 611 provides strength to tent 600 in that this configuration allows tent 600 to withstand high speed winds that a user may encounter when the present invention is in use. In addition, the present invention may be configured so that tent 600 has multiple entry ways/openings, such as side entry way/opening 640 illustrated in FIG. 11. The present invention may also have an entry/way opening at the back of vessel 10 and an entry way/opening opposite of opening 640. In addition to said entry ways, the present invention may be configured with mesh style windows such a user view is not obstructed so that when a user is under tent 600, the user may still see outside of tent 600.

In a preferred embodiment of the present invention, canopy 110 may be easily and quickly lowered as needed when a user is traveling in swampy or marshy waters. For instance, as the present invention is in use and a user encounters low hanging tree limbs or bridges, canopy 110 may be quickly and easily slid down to a closed position and the pole 90 may be easily removed if need be in order for vessel 10 to keep navigating in areas that require a low profile.

Although the present invention and its advantages have been described in detail, it should be understood that various changes, substitutions and alterations can be made herein without departing from the invention. Moreover, the scope of the present application is not intended to be limited to the particular embodiments of the process, machine, manufacture, composition of matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized.

What is claimed is:

1. A self-contained vessel-tent comprising:

a vessel for navigating in shallow waters wherein said vessel comprises:
- a rail;
- a plurality of seating spaces:
- a plurality of storage areas wherein at least one of said plurality of storage areas is isolated from said remaining storage areas and at least one of said plurality of storage areas contains a toilet system;
- a cleat; and
- a trampoline member with grommets located near the front of said vessel that is mounted to said vessel with rope routed through said grommets and attached to said cleat:

a canopy system comprising:
- an umbrella made of fabric comprising:
  - a plurality of layers whereby said plurality of layers provides for improved air flow through said umbrella;
- a slide sleeve mechanism for raising and lowering said umbrella with the application of force to said slide sleeve mechanism;
- a pole that is mounted to said vessel with a fastening mechanism wherein said fastening mechanism comprises:
  - a base bracket with a female member for receiving said pole wherein said base bracket is mounted to said vessel;
  - a securing mechanism for tightening said pole in said female member;
- a plurality of a first set of canopy arms;
- a plurality of a second set of canopy arms whereby one end of said first set of canopy arms connects to said umbrella and the opposite end of said first set of canopy arms connects to a holding mechanism located at the top of said pole, whereby one end of said second set of canopy arms is connected to said first set of canopy arms and the opposite end of said second set of canopy arms is attached to said slide sleeve mechanism;
- a plurality of spacer blocks that are connected to said first set of canopy arms where said first set of said canopy arms connect to said umbrella wherein said spacer blocks provide a space between said first set of canopy arms and said umbrella to improve air flow through said canopy;
- a plurality of eye bolts with loop sections connected to said second set of canopy arms; and a tent member that does not cover the entire vessel wherein said tent member is secured to said canopy with a rope system and can be pitched to create a tent on said vessel for users to sleep in.

2. The self-contained vessel-tent of claim 1 wherein said base bracket of said fastening mechanism is mounted to a truss system located in said vessel wherein said truss system is comprised of multiple members running north-south and east-west.

3. The self-contained vessel-tent of claim 1 wherein said base bracket of said fastening mechanism is mounted to a truss system located in said vessel whereby said truss system comprises at least two pipe members that are attached to said bracket at opposite sides of said vessel and operate to securely fasten said bracket to said vessel.

4. The self-contained vessel-tent of claim 3 wherein at least one of said plurality of storage areas contains a kitchen system.

5. The self-contained vessel-tent of claim 4 wherein said umbrella is made of weather resistant fabric.

6. The self-contained vessel-tent of claim 1 wherein said tent further comprises:

a plurality of entrance points into said tent;

a plurality of tube members for routing said rope system through said tube members whereby one end of said rope system connects to said rail on said vessel and the opposite end of said rope system connects to said loop sections of said eye bolts and acts to secure said tent in a pitched configuration when said umbrella is in an open configuration.

7. The self-contained vessel-tent of claim 6 further comprising:

a plurality of grommets located near the bottom of said tent; and a lower rope system for connecting the bottom of said tent to said rail of said vessel whereby said lower rope system is routed through said plurality of grommets and around the front of said vessel so that one end of said lower rope system ends on the right rear of said vessel and another end of said lower rope system ends on the left rear of said vessel.

8. The self-contained vessel-tent of claim 7 further comprising a fastening member for securing said ends of said lower rope system whereby said fastening member adds tension to said lower rope system.

9. The self-contained vessel-tent of claim 8 whereby said fastening member is a ratchet.

10. The self-contained vessel-tent of claim 6 wherein said tent is comprised of a plurality of lower pattern sections and upper pattern sections that are connected to one another whereby one end of said tent is open.

11. The self-contained vessel-tent of claim 10 wherein said open end of said tent includes zippers that connect to one another creating a door to said tent.

12. The self-contained vessel-tent of claim 10 wherein said upper pattern sections of said tent do not close off said tent and are configured to provide an opening at the top of said tent to allow for ventilation out of said tent.

13. The self-contained vessel-tent of claim 12 wherein said vessel is configured with space between said plurality of seating spaces that enable a user to stand up fully when under said tent.

14. The self-contained vessel-tent of claim 12 wherein said trampoline member and said plurality of seating spaces are configured to provide space for three individuals to sleep on said vessel under said tent.

15. The self-contained vessel-tent of claim 14 wherein at least one of said plurality of storage areas stores water bladders.

16. The self-contained vessel-tent of claim 14 further comprising a water pump to pump said water.

17. The self-contained vessel-tent of claim 14 further comprising at least one solar panel mounted to said canopy.

18. The self-contained vessel-tent of claim 13 wherein said canopy can easily open and close to allow said vessel to navigate in a low profile state whereby a user can easily close said canopy to travel underneath low obstructions.

* * * * *